US005433493A

United States Patent [19]

Dix et al.

[11] Patent Number: 5,433,493

[45] Date of Patent: Jul. 18, 1995

[54] APPARATUS FOR SECURING A LOAD-CARRYING IMPLEMENT TO A LIFTING MEMBER

[75] Inventors: Mark J. Dix, Seattle; Worm Lund, Bellevue; Joseph H. Lanfrankie, Seattle, all of Wash.

[73] Assignee: Lifting Technologies, Inc., Missoula, Mont.

[21] Appl. No.: 37,623

[22] Filed: Mar. 25, 1993

[51] Int. Cl.[6] ..... B66C 1/44; B66F 9/00

[52] U.S. Cl. ..... 294/104; 414/608

[58] Field of Search ..... 294/68.1, 68.3, 101, 294/102.1, 103.1, 104, 114; 108/51.1, 52.1; 182/63, 222; 403/330, 409.1, DIG. 8; 410/129; 414/607, 608, 785

[56] References Cited

U.S. PATENT DOCUMENTS

| | | | |
|---|---|---|---|
| 2,654,629 | 10/1953 | Renfroe | 294/101 |
| 3,003,806 | 10/1961 | Shramek | 294/101 |
| 3,101,128 | 8/1963 | Dane | 414/607 X |
| 3,189,377 | 6/1965 | Gardner | 294/101 |
| 3,336,068 | 8/1967 | Renfroe | 294/101 |
| 3,593,672 | 7/1971 | Breen et al. | 414/608 X |
| 3,889,833 | 6/1975 | Thomas | 414/785 X |
| 4,049,146 | 9/1977 | Decker | 414/607 |
| 5,096,018 | 3/1992 | Dickinson, Jr. | 414/608 X |

OTHER PUBLICATIONS

Miller, "Inventor's Corner," *Wire Rope News and Sling Technology,* Jun., 1990, pp. 31–32 (summarizing U.S. Pat. No. 4,884,836).

Miller, "Inventor's Corner," *Wire Rope News and Sling Technology,* Dec., 1992, p. 42 (summarizing U.S. Pat. No. 5,133,111).

Window Clamping Mechanism (photographs of clamping mechanism encountered in a residence; manufacturer of mechanism unknown).

Product Catalog, Renfroe® Lifting Clamps (1990).

*Primary Examiner*—Johnny D. Cherry

*Attorney, Agent, or Firm*—Klarquist Sparkman Campbell Leigh & Whinston

[57] ABSTRACT

Apparatus are disclosed for securing an implement to a rigid longitudinally extended lifting member. A representative embodiment comprises a clamp that can be mounted to a forklift implement and/or socket for receiving a lifting member. A working surface engages the lifting surface of the lifting member. A cam is pivotably mounted on an axis transverse to and displaced from the working surface. The cam has an outwardly radiating spiraled engagement lobe that presses against the under-surface of the lifting member so as to press the lifting member between the working surface and the cam. Thus, the cam allows the clamp to be moved rearwardly but not forwardly on the lifting member. The cam, which is biased, can be characterized by having a fixed axis, being self-locking, and/or having a constant contact angle with the underside of the lifting member. The cam can also have a release lobe adapted to engage a reference surface for releasing the engagement lobe from the lifting member whenever the clamp is placed upright on the reference surface. The clamp can have multiple cams either similarly or differently sized. Differently sized cams allow the clamp to engage a wider range of lifting-member thicknesses than single-cam clamps.

44 Claims, 13 Drawing Sheets

APPARATUS FOR SECURING A LOAD-CARRYING IMPLEMENT TO A LIFTING MEMBER

FIELD OF THE INVENTION

This invention relates to securing any of various implements such as platforms, bins, containers, man-cages, and the like, to a lifting member, such as on a forklift vehicle, so that said implements can be safely elevated or transported without falling off the lifting member.

BACKGROUND OF THE INVENTION

Although platforms, bins, containers, man-cages, and other such appliances can be elevated or transported using a variety of means, such as cranes and the like, a convenient way to elevate or transport such appliances is by employing a forklift vehicle. Forklifts as generally known in the art are self-propelled vehicles having a lifting member (e.g., a lifting "fork") usually located on the front end and which is used to lift goods-loaded pallets and other heavy or bulky items for transportation to remote locations or for movement from one elevation to another. A typical lifting member is a lifting fork having two outwardly projecting parallel tines. Such a lifting fork is typically mounted on a substantially vertical track, or "mast" on the vehicle The mast is equipped with a winch or analogous mechanism used to raise and lower the lifting member relative to the vehicle.

The term "implement" as used herein encompasses various types of industrial load-carrying appliances such as platforms, bins, containers, man-cages, and the like, that are adapted to be engaged with a lifting member on a forklift vehicle so as to permit personnel, material, and equipment loaded on or in such appliances to be elevated by the forklift vehicle to high, otherwise inaccessible locations, or to be transported by the forklift vehicle from one location to another.

To elevate an implement using a forklift equipped with a lifting fork, the tines of the fork are typically placed beneath the implement. Some implements are provided with underside grooves, channels, or sockets to ensure that the tines are placed properly relative to the mass of the implement and to prevent the implement from sliding laterally off the tines.

Many forklifts are equipped with means for adjusting the forward and rearward tilt of the mast which, in turn, adjusts the tilt of the tines from horizontal. Adjusting the fork so that the tines are angled downward relative to horizontal can pose a substantial hazard in that the implement can slide in a forward direction off the fork. Even if the tines are not angled downward, it is possible for an implement to slip forward off the fork if a forward-moving forklift vehicle carrying the implement stops suddenly, or if weight of the load in or on the implement shifts position on the tines. Sliding of the implement on the tines in a rearward direction does not pose as great a risk since such movement tends to place the implement more completely on the tines. Also, excessive rearward movement of the implement on the tines is usually obstructed by the mast and by various abutting plates or bars situated behind and above the tines.

Several methods and apparatus are known in the art for securing objects to the tines of a lifting fork. For example, U.S. Pat. No. 5,096,018 to Dickinson, Jr. discloses a clamp adapted to be mounted to a tine socket on an implement. The clamp applies a gripping force to the underside of the tine whenever the fork has elevated the implement off a reference surface, and releases the tine whenever the implement is resting upright on the reference surface. The clamp comprises a lever pivotably mounted at about mid-length to the tine socket, at least one gripping cam rotatably mounted to one end of the lever, and a cam-release member mounted to the opposing end of the lever. The lever is biased using strong springs to maintain the gripping surface of the cam in contact with the underside of the tine whenever the tine is in the socket and the implement is elevated. The cam has an outwardly spiraled profile and is allowed a limited degree of rotational freedom about its axis. Whenever the cam is engaged against the underside of the tine, rotation of the cam causes the gripping force applied by the cam to increase principally because, as the cam rotates, the springs stretch to a longer length so as to apply more tension to the lever; and the effective spring lever arm changes to apply more torque to the lever. The cam-release member contacts the reference surface whenever the implement is resting upright thereon. This causes the lever to pivot against the bias and draw the cam away from contact with the underside of the tine, thereby allowing the tine to be withdrawn from the socket.

The primary disadvantage of a clamp according to Dickinson, Jr. arises from the location of the cam on an end of the lever that does not serve as the fulcrum of the lever. Thus, as the tine is being urged out of the socket, the resulting rotation of the cam causes the cam pivot axis to move away from the tine. That is, the cam pivot axis is not fixed. The springs connected to the lever cannot practicably be made strong enough to prevent such movement of the cam pivot axis. Consequently, such a clamp may not be capable of gripping a tine strongly enough in all instances to prevent an implement from sliding off the fork.

Other disadvantages of a clamp according to Dickenson Jr. are the following: First, debris can accumulate atop the shoe employed for releasing the cam. Such an accumulation can prevent the lever from pivoting sufficiently to release the cam. Second, the shoe depending from the lever is easily caught on obstacles which can cause substantial damage to the shoe and other portions of the clamp mechanism. Third, the clamp relies substantially upon the teeth in the cam to grip the underside of the tine; if the teeth should become worn, then the gripping power of the cam is significantly reduced.

U.S. Pat. No. 3,889,833 to Thomas discloses plural manually pivotable "square Z" latches provided on a manbasket for engaging the abutting plate of a forklift. A disadvantage of such latches is that they are usable only with a forklift having an abutting plate with the proper depth and located the proper distance above the tines. Also, such latches are biased by gravity to return to the latched position, which is not fail-safe. For example, if the latch journal fails to allow free rotation of the latch due to rust or incursion of dirt, the latch may not engage the abutting plate, particularly if one forgets to manually engage the latch. Another disadvantage is that the latches must be manually opened, which can be inconvenient.

U.S. Pat. No. 3,101,128 to Dane discloses a personnel platform provided with sets of parallel channels adapted for receiving the tines of a lifting fork therebetween. Each set of channels has an opening into which a tine is inserted. Each opening is partially obstructed with a vertical plate adapted to become situated behind the heel of the tine whenever the manbasket is lifted off the ground by the lifting fork. Unfortunately, providing such a feature requires that the personnel platform rest in a tilted orientation on the ground to allow insertion of the tines. Also, the platform is provided with an inwardly tilting side panel to permit incursion of the forklift mast between two lateral sides of the platform. Hence, Dane discloses an elaborate mechanical interconnection between the tilting side panel and a pair of swingable legs which keep the platform in a tilted position on the ground. The fact that the platform must remain tilted on the ground is disadvantageous because workers are discomforted thereby. Also, the tilted floor can make it difficult to stabilize equipment and tools placed on the platform until the platform is elevated by the forklift. Also, proper placement of the platform on the tines requires appreciable manual intervention, including moving the tilted side panel into a vertical position after the platform has been lifted off the ground.

Another means known in the art for securing an implement to a lifting member includes a chain passed around the mast and fastened to the implement. A disadvantage of this method is that it is easy to forget or ignore fastening the chain.

Another means known in the art is to fasten an implement to a lifting member using pins or screws or the like. This method has the disadvantage in that pins or screws must be manually engaged against the lifting member before elevating the implement and manually released when the implement is not in use. Also, screws are vulnerable to damage by the lifting member. For example, U.S. Pat. No. 4,049,146 to Decker discloses a screw mechanism which is used to secure an implement to the tines of a lifting fork.

Hence, there is a need for an apparatus for securing an implement to a lifting member which will reliably prevent the implement from slipping forwardly on the lifting member when the implement is elevated by the lifting member.

There is also a need for such an apparatus wherein the securing of the implement to the lifting member is automatic (i.e., requiring no deliberate action by personnel to engage the securing means before the implement is elevated).

There is also a need for such an apparatus that automatically disengages the lifting member from the implement whenever the implement is resting upright on the ground or other reference surface.

There is also a need for such an apparatus that can be used to secure an implement to lifting members of different makes and models of forklift vehicles without the need for intervening adaptive action.

There is also a need for such an apparatus that is of a simple design utilizing a minimum of mechanical parts.

SUMMARY OF THE INVENTION

It is, therefore, an object of the present invention to provide an apparatus for automatically and reliably securing an implement to a lifting member so as to prevent the implement from sliding forwardly off the lifting member whenever the lifting member has elevated the implement off the ground or other reference surface.

Another object of the present invention is to provide such an apparatus wherein the implement is secured to the lifting member only when the implement is elevated off the reference surface, thereby allowing the lifting member to be conveniently manipulated into the proper orientation relative to the implement before elevating the implement.

Another object of the present invention is to provide such an apparatus wherein the lifting member is automatically disengaged from the implement whenever the implement is resting in an upright position on the ground or other reference surface, thereby allowing the vehicle on which the lifting member is mounted to be conveniently driven away from the implement and used for other work.

Another object of the present invention is to provide such an apparatus enabling the implement to be secured to the lifting member of virtually any type of forklift or analogous vehicle and to lifting members of varying thicknesses.

Another object of the present invention is to provide such an apparatus wherein the force by which the implement is secured to the lifting members is self-adjusting and is self-locking, wherein the force increases progressively in magnitude as the implement is urged more forcefully to slide off the lifting member.

These and other objects of the present invention that will become hereinafter apparent are realized with the present invention which provides apparatus for securing an implement to a lifting member.

According to a preferred embodiment of the present invention, a clamp is provided that is adapted to engage a rigid, longitudinally extended lifting member, such as a tine of a lifting fork, having a lifting surface and an opposing under-surface. The clamp engages the lifting member in such a way that, whenever the lifting member has elevated the clamp of a reference surface (such as the ground or a floor), the clamp can be moved rearwardly on the lifting member but not substantially forwardly on the lifting member.

A representative clamp comprises at least a working surface, adapted to engage at least a portion of the lifting surface of the lifting member, and at least one cam pivotably mounted on an axis.

The axis is situated such that, whenever the lifting member is being used to elevate the clamp off the reference surface, the lifting member is placed between the cam and the working surface. The axis is preferably fixed relative to the working surface or positioned so as to enable the cam to self-lock against the under-surface of the lifting member.

The cam comprises an engagement lobe that defines a contact edge having an outwardly radiating spiraled profile relative to the axis. The engagement lobe is adapted to extend toward the working surface so as to allow a location on the contact edge to engage the under-surface of the lifting member whenever the lifting surface of the lifting member is engaged against the working surface. The cam is adapted to pivot about the axis so as to apply a force against the under-surface of the lifting member serving to press the lifting surface against the working surface whenever the lifting member has elevated the clamp off the reference surface and the clamp (and anything attached thereto) is being urged to move forwardly on the lifting member but not when the clamp (and anything attached thereto) is being urged to move rearwardly on the lifting member. The force applied by the cam has a magnitude that increases correspondingly as the clamp (and anything attached thereto) is being urged more strongly to move forwardly on the lifting member.

The contact edge of the cam preferably engages the under-surface of the lifting member at a constant contact angle, no matter which location on the contact edges actually engages the under-surface of the lifting member. Hence, the contact edge preferably has a logarithmically spiraled profile.

The clamp also preferably comprises a bias adapted to apply a pivoting force to the cam about the axis. The bias thus keeps the engagement lobe oriented toward the working surface whenever the clamp is not resting upright on the reference surface. As a result, the contact edge is kept in contact with the under-surface of the lifting member whenever the lifting member is being used to elevate the clamp off the reference surface. According to a preferred embodiment, the bias comprises at least one extension spring.

The cam is also preferably self-locking, which means that the cam will not experience any substantial slip relative to the lifting member whenever the clamp is not resting upright on the reference surface and is being urged to move forwardly on the lifting member.

The clamp also preferably comprises means for releasing engagement of the contact edge with the under-surface of the lifting member whenever the clamp is resting upright on the reference surface. According to a preferred embodiment, such a release means comprises a release lobe on the cam extending substantially oppositely relative to the contact lobe. The release lobe includes an edge surface adapted to contact the reference surface whenever the clamp is resting upright on the reference surface. Contact of the release lobe with the contact surface applies a torque to the cam serving to pivot the cam against the bias, thereby causing the engagement lobe to pivot away from engagement with the under-surface of the lifting member and allowing the lifting member to be withdrawn from the clamp. The edge surface of the release lobe preferably defines a spiraled profile that enables contact of any location on the edge surface to apply substantially the same "lever arm" to the cam.

The clamp is preferably at least partially enclosed in a housing from which, in a preferred embodiment, the release lobe projects substantially downward whenever the clamp is elevated above the reference surface.

According to another embodiment, the clamp can include a socket adapted to receive the lifting member whenever the lifting member is being used to elevate the clamp (and anything attached thereto) above the reference surface.

Other embodiments of apparatus according to the present invention include combinations of a clamp and an implement, and of a clamp, a socket, and an implement.

A clamp according to the present invention can comprise either one or multiple cams. In multiple-cam embodiments, the cams can be of the same size to impart redundancy to the clamping action. The cams can also be of different sizes so as to increase, over single-cam embodiments, the range of thicknesses of lifting members that can be clamped by a particular clamp.

DETAILED DESCRIPTION

Figure 1:
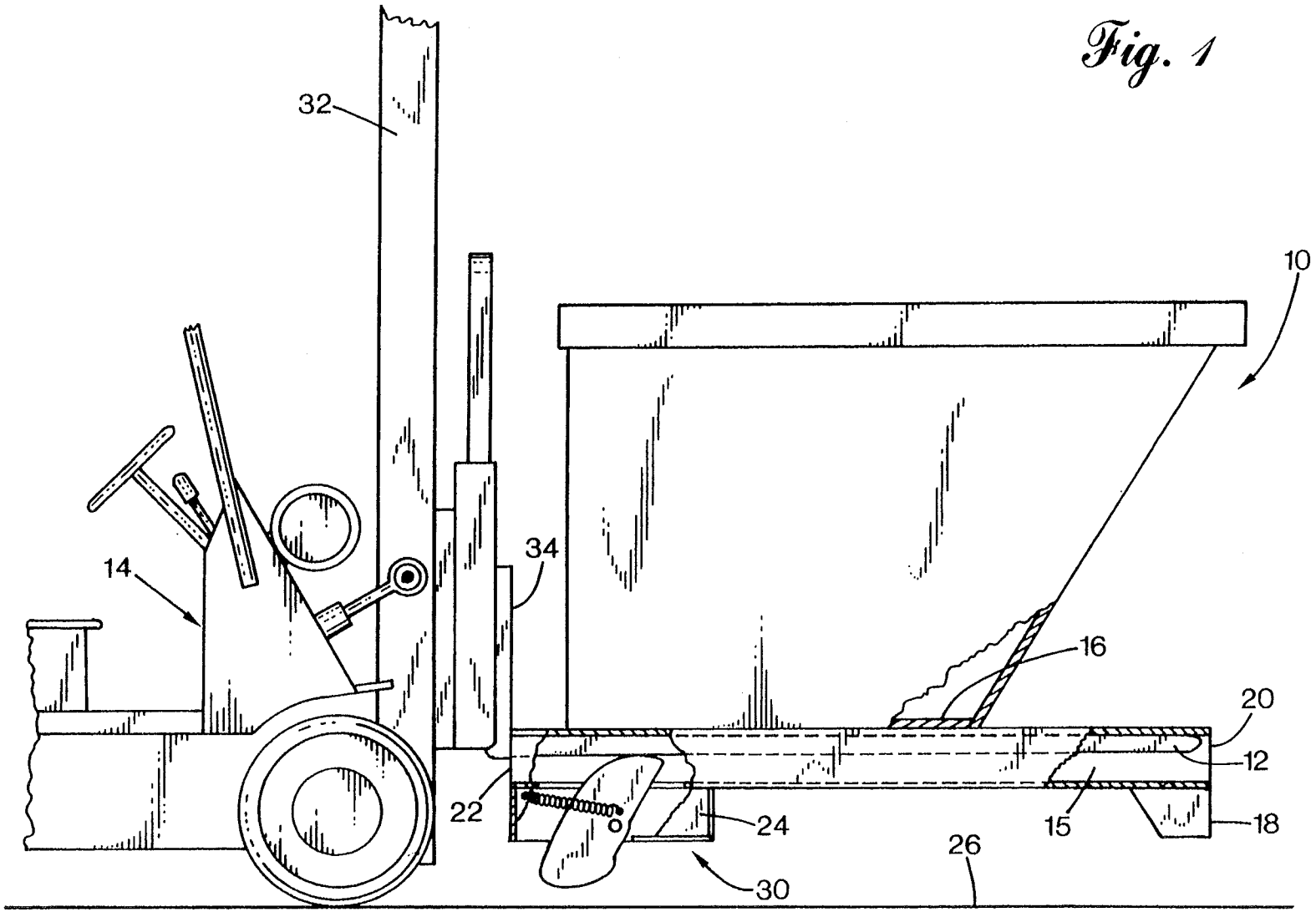
FIG. 1 is a side elevational view of an implement supported on a lifting member of a forklift vehicle and secured to the lifting member by a clamp according to the present invention.

Referring to FIG. 1, an implement 10 according to the present invention is shown positioned on an elevated lifting member 12 of a forklift vehicle 14.

Although the implement 10 is depicted as an industrial dumpster, it will be understood that the implement can be any of various other appliances as defined hereinabove.

Also, whereas a forklift vehicle is typically equipped with a lifting fork having at least one lifting member configured as a "tine" of the lifting fork, it will be understood that the lifting member can have any of various other configurations having at least one outwardly extended portion adapted for supporting and lifting an implement.

Conventional lifting forks typically have two parallel lifting members (tines). A second lifting member not visible in FIG. 1 is situated similarly to the obverse lifting member 12 shown, but beneath the opposite side of the implement 10.

The implement 10 preferably includes a separate socket 15 or analogous feature for each lifting member 12. (Only an obverse socket 15 is shown in FIG. 1; a second socket, parallel to the obverse socket 15, is provided beneath the opposite side of the implement 10.) According to the FIG. 1 embodiment, the sockets 15 are typically provided beneath an implement base 16 in a bilaterally symmetrical manner.

In the FIG. 1 embodiment, a pad 18 is provided at or near the distal end 20 of each socket 15. At or near the proximal end 22 of each socket 15 is provided a housing 24 described in further detail hereinbelow. The combination of the housings 24 and the pads 18 keeps the implement base 16 substantially horizontal whenever the implement 10 is resting upright on the ground or other horizontal reference surface 26.

As used herein, a "reference surface" 26 is the ground or any other surface on which the implement 10 can rest upright, generally for the purpose of loading or unloading materials, personnel, or equipment to and from the implement, respectively. The reference surface 26 need not be the same surface on which the forklift vehicle 14 is resting. Also, the reference surface need not be horizontal.

The sockets 15 guide the forklift operator in positioning the lifting members 12 properly for elevating the implement 10 so as to yield a substantially balanced load on the lifting members 12. The sockets 15 also help prevent the implement 10, when elevated by the lifting members 12, from sliding transversely off the lifting members 12. In addition, whenever the implement 10 of FIG. 1 is resting upright on the reference surface 26, the sockets 15 create a gap between the implement base 16 and the reference surface 26 which enables the forklift operator to easily interpose the lifting members 12 between the implement base 16 and the reference surface 26 for the purpose of elevating the implement 10.

At least one socket 15 is also provided with an automatic clamp 30 according to the present invention, described in detail hereinbelow. The clamp 30 is rigidly attached to the socket 15. The clamp 30 is termed "automatic" because the only activity necessary to cause it to firmly engage a corresponding lifting member 12 is insertion of the lifting member 12 into the corresponding socket 15 and raising of the lifting members 12 sufficiently to elevate the implement 10 off the reference surface 26. The term "automatic" also denotes that the clamp 30 disengages without manual intervention from the lifting member 12 whenever the implement 10 is resting upright on the reference surface 26, thereby allowing the lifting members 12 to be freely inserted into or removed from the sockets 15.

Whenever the lifting members 12 have elevated the implement 10 off the reference surface 26, the clamp 30 engages the corresponding lifting member 12 so as to prevent the implement 10 from sliding "forwardly" on the lifting members 12 (away from the forklift mast 32; i.e., longitudinally toward the distal ends of the lifting members) while permitting the implement 10 to be moved "rearwardly" on the lifting members 12 (toward the mast 32; i.e., longitudinally away from the distal ends of the lifting member). Movement of the implement 10 rearwardly is permitted because each of the lifting members 12 typically has a vertical portion 34 which obstructs excessive rearward movement of the implement 10. In other words, the clamp 30 prevents the corresponding lifting member 12 from being removed from the socket 15, but not necessarily from being moved further into the socket 15, whenever the lifting members 12 have elevated the implement 10 off the reference surface 26.

In the embodiment shown in FIG. 1, the clamp 30 is substantially enclosed within the clamp housing 24. Although it not necessary to have a fully enclosed housing, the housing 24 inhibits incursion of dirt and other foreign matter into the clamp, and provides other benefits as discussed below.

The clamp 30 is preferably located at or near the proximal end 22 of the socket 15 to ensure that the corresponding lifting member 12 is gripped by the clamp 30 even when the lifting member 12 is inserted only part way into the socket 15.

For optimal safety, the implement 10 is preferably provided with a separate clamp 30 for each lifting member 12. On most conventional forklift vehicles, the lifting fork has two lifting members (tines) 12 each intended for insertion into a separate socket; therefore, the implement 10 preferably has a clamp 30 provided in association with each socket 15.

Referring further to the implement 10 shown in FIG. 1, the "working portion" is that portion of the implement 10 exclusive of the sockets 15 and clamps 30.

Although the clamp 30 is most preferably constructed of steel for most applications, it will be understood that any suitably strong and rigid material or combination of materials can be used, depending upon the intended use conditions and size of the clamp.

FIGS. 2–5 depict an embodiment of a clamp assembly 40 according to the present invention that is adapted to be mounted to a socket via a "vertical" or transverse, flange mounting. (In FIGS. 2–5, items similar to those shown in FIG. 1 are assigned similar reference designators.) Also, in FIGS. 2–5, portions of the housing and socket are shown cut away for clarity.

The clamp assembly 40 of the embodiment of FIGS. 2–5 comprises a socket portion 15A that, when the clamp assembly 40 is mounted to a socket 15 as shown, contiguously extends from the socket 15. The clamp assembly 40 is provided with a transverse mounting flange 42 adapted to be coupled to a similarly shaped transverse mounting flange 44 provided on the proximal end 22 of the socket 15. Bolts 46 or analogous fastening means can be used to fasten the flanges 42, 44 together face-to-face. The mounting flange 44 can be made extremely rigid relative to the socket 15 by one or more gussets 48 affixed to the socket 15 and mounting flange 44 such as by welding.

The socket 15 of the embodiment of FIGS. 2–5 is defined by a first socket wall 50 and an opposing second socket wall 52. The socket 15 also comprises a first side wall 54 and a second side wall 56. Correspondingly, the socket portion 15A of the clamp assembly 40 comprises a first socket wall 50A, a second socket wall 52A, a first side wall 54A, and a second side wall 56A.

The lifting member 12 has a lifting surface 58 and an opposing under-surface 60. The first socket walls 50, 50A have interior surfaces 62, 62A, respectively, adapted to contact the lifting surface 58 whenever the lifting member 12 is inserted, as shown, into the socket 15, 15A and is applying a net elevating force (arrow 64) to the clamp assembly 40 in an upright orientation.

Figure 2:
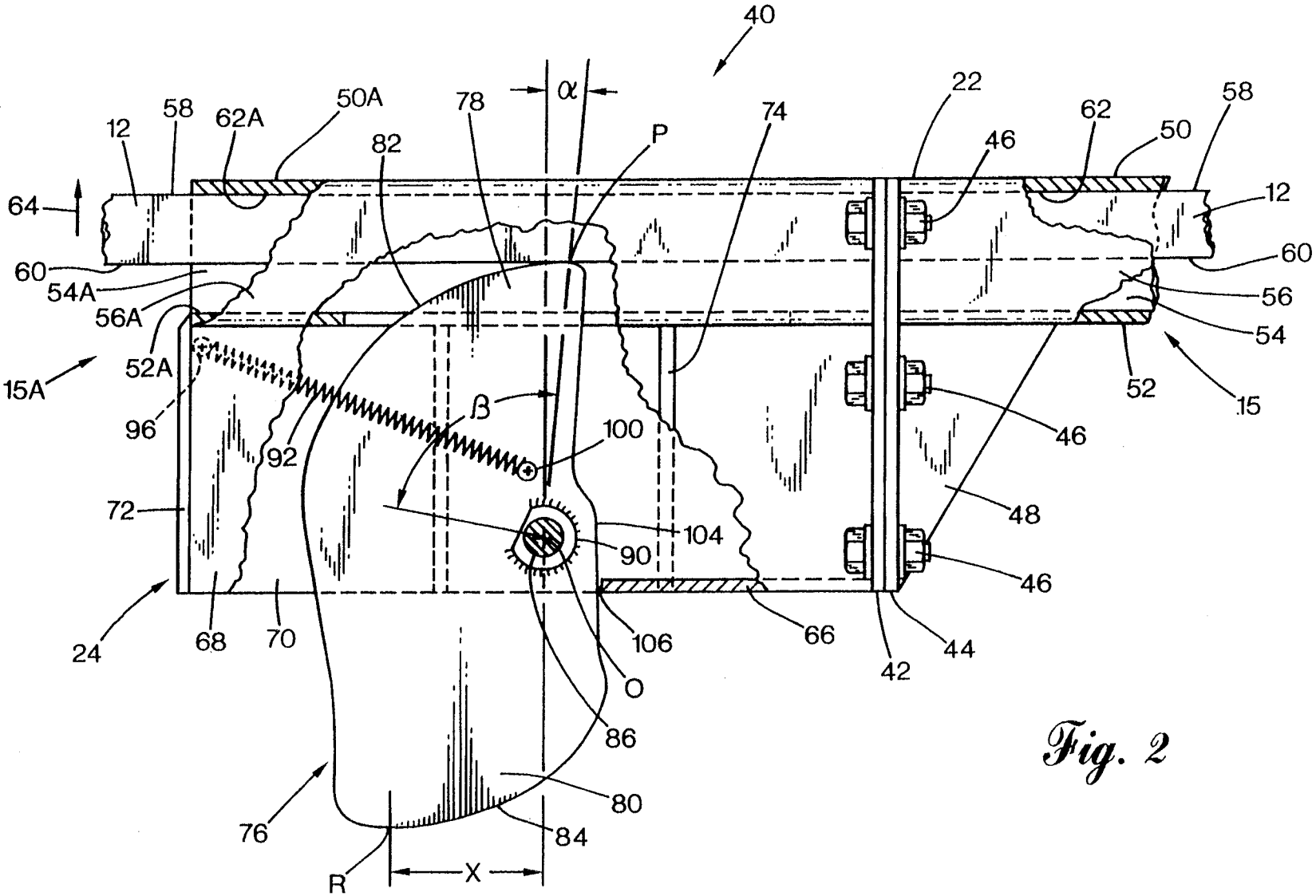
FIG. 2 is a side, partially cutaway, elevational view of a one-cam clamp according to the present invention adapted to be mountable via a transverse mounting flange to a socket for receiving the tine of a lifting fork.

As used herein, a "working surface" is a surface adapted to engage the lifting surface of a lifting member. In FIG. 2, for example, the working surface encompasses the interior surfaces 62, 62A of the first socket walls 50, 50A.

Also shown in FIGS. 2–5 is the clamp housing 24 comprising a bottom panel 66, side panels 68, 70, and an end panel 72. The side panels are welded to the flange 42 which serves as an end panel opposite the end panel 72. For additional rigidity and resistance to deformation, gussets 74 are welded to the side panels 68, 70 and to the exterior of the second socket wall 52A.

At least partially enclosed by the housing 24 is a cam 76 comprising an engagement lobe 78 and preferably a release lobe 80. The cam 76 is pivotably mounted to the housing 24 in a manner allowing the cam 76 to pivot about a fixed transverse axis A (shown most clearly in FIG. 3) extending through the side panels 68, 70. The axis A is fixed relative to the working surface 62, 62A. The engagement lobe 78 is adapted to extend into the socket 15A toward the interior surface 62A so as to be able to engage the under-surface 60 of the lifting member 12. As the engagement lobe 78 thus extends into the socket 15A, the release lobe extends out of the socket 15A so as to be able to contact the reference surface (not shown) should the clamp assembly 40 be lowered upright onto the reference surface.

Figure 3:
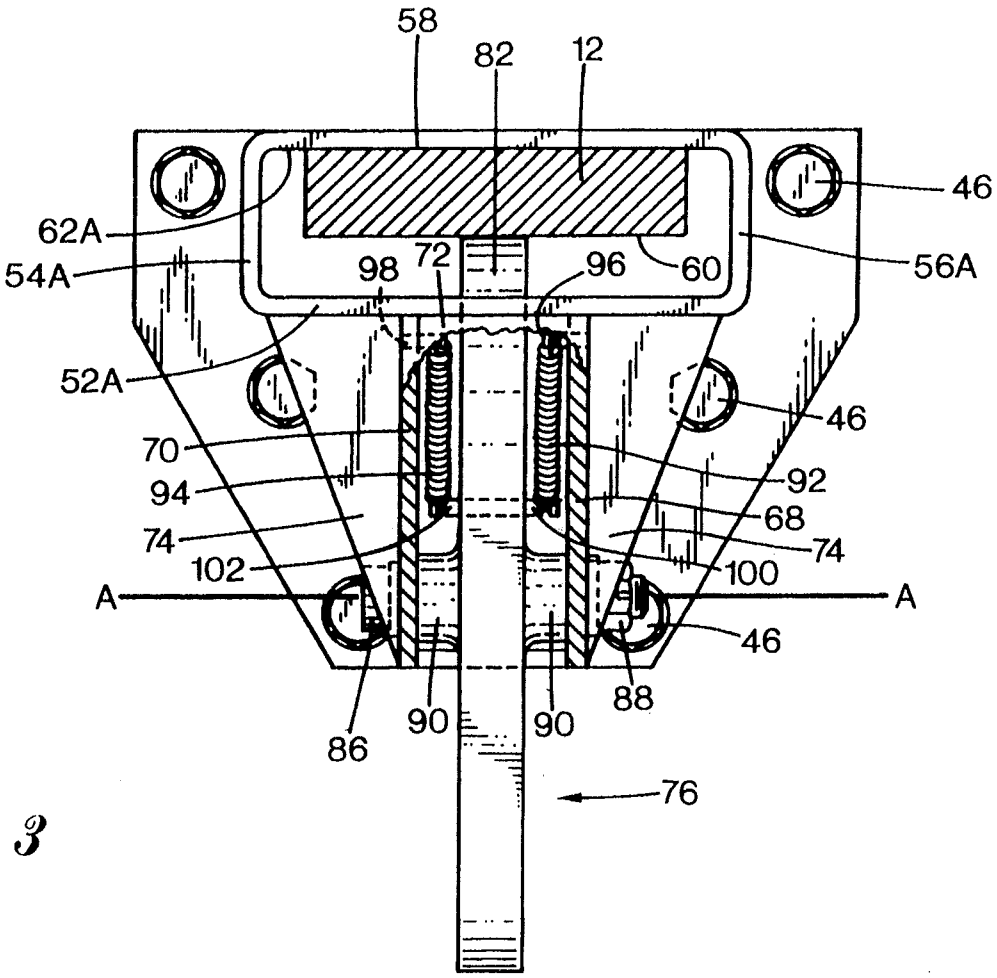
FIG. 3 is an end view of the clamp shown in FIG. 2 with a portion of an end panel of the clamp housing cut away to reveal interior detail.

Referring particularly to FIG. 3, the cam 76 is pivotably mounted preferably to the side panels 68, 70 via a bolt 86 and nut 88 or other suitable fastening means that provides an axle about which the cam 76 is allowed to pivot. The cam 76 is preferably provided with integral shoulders 90 which increase the stability of the cam 76 on the bolt 86 and center the cam 76 on the bolt 86 relative to the side panels 68, 70.

Referring to FIG. 2, for example, the cam 76 is provided with a bias means to maintain the cam in a maximal counterclockwise pivoted orientation. As a result, whenever a lifting member 12 of suitable thickness is inserted into the socket 15, 15A and has elevated the clamp assembly 40 off the reference surface (not shown), the contact edge 82 of the cam 76 is reliably brought into contact with the under-surface 60 of the lifting member 12.

According to the embodiment of FIGS. 2–5, the bias means preferably comprises at least one extension spring. As shown most clearly in FIG. 3, two extension springs 92, 94 are preferred, one on each side of the cam 76. One end of each spring 92, 94 is coupled to a pin 96, 98, respectively, affixed to the corresponding side wall 68, 70, respectively, and an opposing end of each spring is coupled to a pin 100, 102, respectively, affixed to the cam 76. Thus, in FIGS. 2 and 4–5, the cam 76 is biased by the springs 92, 94 to pivot in a counterclockwise direction.

Clamps according to the present invention can also comprise other bias means. For example, the bias means can comprise one or more compression springs or torsion springs suitably placed so as to impart substantially the same bias to the cam as the extension springs shown in FIGS. 2–5. The bias means can also reside in the cam itself. For example, FIG. 2 shows that the cam axis (perpendicular to the plane of the page at O) is displaced toward a lateral edge 104 of the cam, thereby imparting a moment to the cam 76 serving to urge the cam to rotate counterclockwise about its axis. In other words, the bias means can comprise gravity itself.

The engagement lobe 78 defines a contact edge 82 adapted to contact the under-surface 60 of the lifting member 12 at a location P whenever the lifting member 12 is in the socket 15, 15A and is applying a lifting force to the working surface 62, 62A. (The location P on the contact edge 82 is not fixed but rather depends upon the thickness of the lifting member 12.)

Referring to FIG. 3, any location on the contact edge 82 spanning the thickness dimension of the cam 76 is linear and parallel to the axis A for most applications in which the contact edge 82 is intended to engage a substantially flat under-surface 60 of a lifting member. Other applications may require a non-linear profile. For example, in instances in which the lifting member has a circular cross-section, the contact edge, when viewed endwise as in FIG. 3, advantageously has a conforming semicircular profile.

The profile of the contact edge 82 in the plane shown in FIG. 2, (i.e., the plane perpendicular to the axis A) is generally an outwardly radiating spiral. The contact edge 82 contacts the under-surface 60 of the lifting member 12 at a "contact angle" that is substantially constant at any of various pivotal orientations of the cam on the axis A. As a result of the outwardly radiating spiraled profile of the contact edge 82, the distance between the locations O and P increases as the cam 76 pivots about its axis in a counterclockwise direction (relative to the perspective shown in FIG. 2).

Figure 6A:
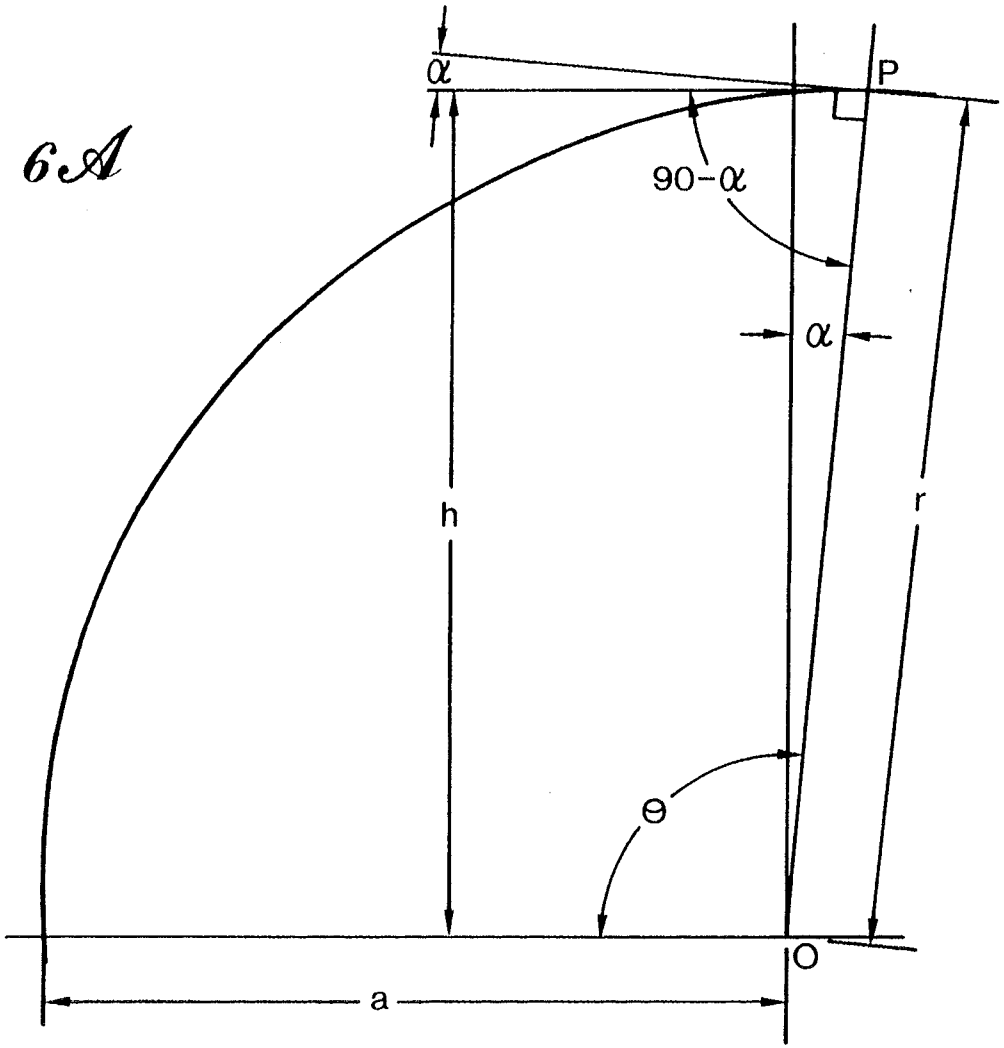
FIG. 6A is a diagram showing a portion of a representative logarithmic spiral, used as the profile of the contact edge of a cam in a clamp according to the present invention, showing several variables that appear in equations used to generate the spiral.

In particular, the spiraled profile of the contact edge 82 is that of a logarithmic spiral. As is known in the art, a logarithmic spiral is an outwardly spiraling curve about an origin O. (A portion of such a curve is shown in FIG. 6A.) A logarithmic spiral intersects, at a constant angle $\alpha$, all rays passing through O. The logarithmic spiral is represented as the locus of points r about O defined by the polar equation $r=a.e^{m.rad\theta}$, where r is the radial distance from O to a point P on the spiral, a is an initial radius (typically on an axis passing through O) from which the portion of the spiral begins ($a>0$), $\theta$ is the sweep angle of a line passing through P and O relative to the line defined by a (i.e., $a=r$ when $\theta=0$), and $m=\cot(90-\alpha)$. FIG. 6A shows a portion of a logarithmic spiral depicting O, r, a, a, and $\theta$. In the context of a contact edge 82 on a cam 76 according to the present invention, the axis A (FIG. 3) would pass perpendicularly (relative to the page) through O, and $\alpha$ (FIG. 2) would represent the contact angle formed by the contact edge 82 with the under-surface 60 of the tine 12. In FIG. 6A, h represents a line normal to the under-surface 60 of the tine 12. Hence, in FIG. 6A, $r=a.e^{m.rad\theta}$, and $h=(a.e^{m.rad\theta})\cos\alpha$. Of course, if $\alpha$ were equal to 0°, the curve would be a circle about O, not a spiral.

Clamps according to the present invention are "self-locking". That is, whenever (a) a lifting member is interposed in the clamp between the working surface and the cam axis, (b) the lifting member has thus elevated the clamp (and any implement to which the clamp is mounted) off the reference surface, and (c) an attempt is being made to pull the clamp forwardly on the lifting member, the clamp will not experience any substantial slippage relative to the lifting member. Also, clamps according to the present invention, in contrast to, e.g., clamps as disclosed in U.S. Pat. No. 5,096,018, do not rely upon tension exerted by springs or other bias means to maintain a clamped condition.

The ability of a cam in a clamp according to the present invention to self-lock against the under-surface of a lifting member depends upon the coefficients of friction of the contact edge of the cam and of the under-surface of the lifting member, and upon the contact angle $\alpha$. For example, in a clamp having a steel contact edge and intended to engage a steel lifting member, $\alpha$ can be within a range of greater than 0° to about 80°. The most preferable value of $\alpha$ in such an instance is about 5°. An angle of 5° results in consistent self-locking of the cam against the under-surface of the lifting member, even when oil or other lubricant is present on either the contact edge, the under-surface of the lifting member, or both. An angle of about 8° for such cams and lifting members sometimes undesirably allows the lifting member, particularly if lubricated, to slip relative to the contact edge.

A clamp having a steel contact edge is also self-locking against a lifting-member having an under-surface made of a material other than steel with a coefficient of friction at least as great as lubricated steel. Likewise, a clamp having a contact edge made of a material other than steel but having a coefficient of friction at least as great as that of lubricated steel is also self-locking against a steel lifting member. If the contact edge and/or the under-surface of the lifting member were made of a material having a coefficient of friction less than lubricated steel, then a smaller contact angle ($\alpha$) may be required to achieve self-locking.

The contact angle $\alpha$ should not, however, be so small (but still greater than 0°) that the cam cannot be readily disengaged from the under-surface of the lifting member whenever the clamp (and any implement to which the clamp is mounted) is placed on the reference surface. (Release of the cam from the lifting member is described in further detail below.)

Figure 6B:
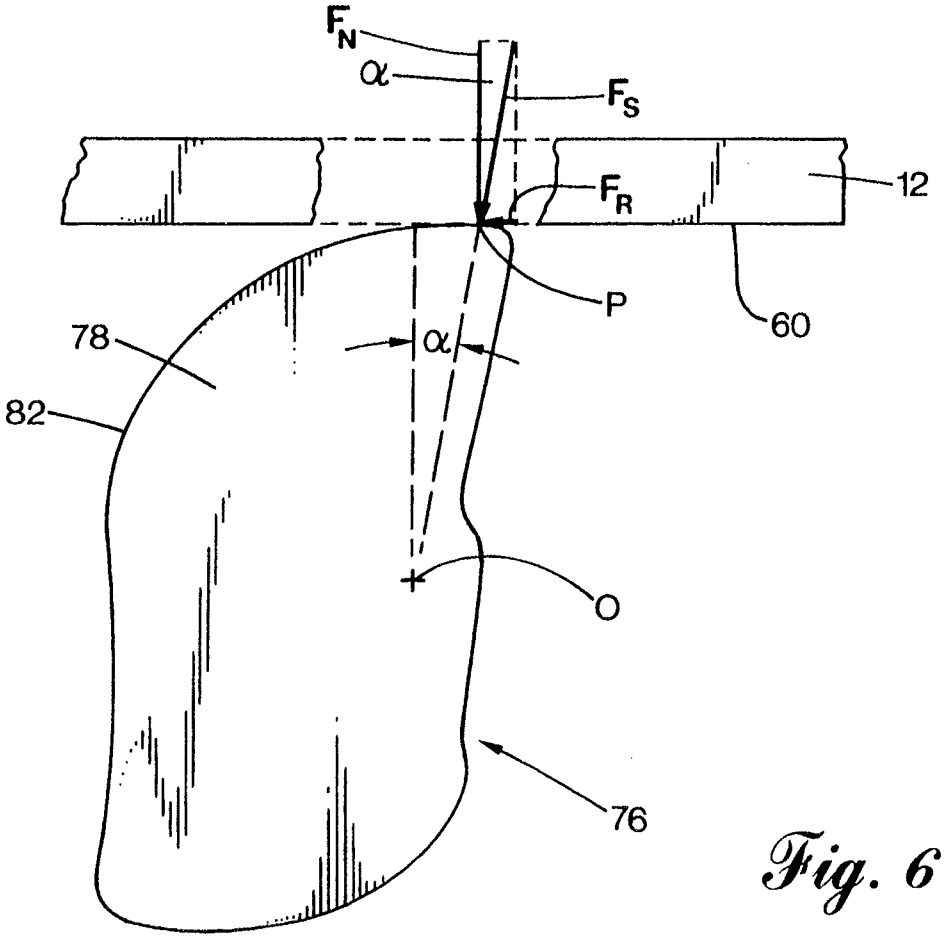
FIG. 6B is a diagram depicting certain force vectors at the location where, in a clamp according to the present invention, a cam contacts the under-surface of a lifting member.

A vector analysis of a self-locking cam of a clamp according to the present invention is illustrated in FIG. 6B. At the location P on the contact edge 82, the vector $F_S$ represents the force applied by the cam 76 against the underside 60 of the lifting member 12 whenever the lifting member 12 has elevated the clamp off the reference surface (not shown) and the clamp is being urged to move forwardly on the lifting member. As can be seen, $F_S$ resides on a line perpendicular to the axis (the axis being perpendicular to the page at O) that passes through P, and has a magnitude proportional to the magnitude of the force with which a clamp is being urged forwardly on the lifting member 12. The vector $F_N$ is the normal force component of $F_S$; $F_R$ is the force component of $F_S$ that is parallel to the contact edge 82 and the under-surface 60 of the lifting member at location P; and $\alpha$ is the contact angle. The proportional relationship between $F_N$ and $F_R$ is fixed for a given value of e, regardless of the magnitude of $F_S$. Another force acting at P is a frictional force $F_F$ (not shown), which is parallel to $F_R$. The maximal frictional force, $F_{Fmax}$, is given by $F_{Fmax}=F_N(\mu)$, wherein $\mu$ is the static coefficient of friction between the contacting surfaces at location P. For practical ranges of force applied to the clamp in an effort to urge it to move forwardly on the lifting member 12, $\mu$ is constant. Furthermore, (a) whenever $F_{Fmax}>F_R$, the cam is self-locking; (b) whenever $F_{Fmax}=F_R$, the surfaces in contact at location P are on the verge of slipping; and (c) whenever $F_{Fmax}<F_R$, the surfaces in contact at location P are prone to slip.

Since the vector $F_S$ resides on a line passing through O and P, a clamp according to the present invention can apply a clamping force to a lifting member that is limited only by the strength of the material from which the clamp is fabricated. Thus, in contrast to the clamp embodiments disclosed in U.S. Pat. No. 5,096,018, none of the force applied by the cam 76 to the lifting member 12 is dissipated by the pivoting of a lever which would tend to move the cam axis away from the lifting member.

A key aspect of the self-locking feature is that the cam will reliably engage a lifting member without the need to provide teeth or analogous gripping aids on the contact edge (although teeth or analogous gripping aids can be provided on the contact edge, if desired). Of course, if teeth or the like were provided on the contact edge (wherein the teeth serve to increase the coefficient of friction of the contact edge against the under-surface of the lifting member), then the maximum allowable value of $\alpha$ could be greater than the values discussed above. However, teeth and the like ultimately experience considerable blunting and other wear which could render a cam with too great a value of $\alpha$ eventually incapable of self-locking.

The release lobe 80 of the cam 12 shown in FIGS. 2–5 comprises an edge surface 84 that also defines a spiral relative to O. When the clamp assembly is lowered onto a reference surface, contact of the release lobe 80 on the reference surface is made at a location R on the edge surface 84 that is always displaced a certain distance x from a line perpendicular to the reference surface passing through O. (On the preferred cam embodiment shown in FIGS. 2–5, the edge-surface profile on the release lobe 80 is actually configured as an involute of a circle having a radius x.) As used herein, the distance x is termed the "lever arm" of the release lobe 80.

In the embodiment of FIGS. 2–5, to release the cam 76 from the lifting member 12 so as to allow the lifting member 12 to be removed from the socket 15, 15A, it is merely necessary to lower the clamp assembly 40 in an upright orientation onto a reference surface. The edge surface 84 of the release lobe 80 contacts the reference surface and effectively applies a torque to the cam 76 (in FIG. 2, clockwise about the axis). Since the lever arm x has a constant length regardless of which location R on the edge surface 84 contacts the reference surface, substantially the same "release torque" will be applied to the cam each time the clamp is lowered onto the reference surface, all other factors being equal. As x is made longer, more "release torque" can be applied to the cam 76.

It will be appreciated that a number of factors influence the amount of torque necessary to release the cam. These factors include, but are not limited to:

(a) the force with which the clamp 40 was previously pulled forwardly (to the left in FIG. 2) relative to the lifting member 12;
(b) the coefficient of friction between the lifting surface 58 and the "working surface" 62, 62A;
(c) the coefficient of friction between the contact edge 82 and the under-surface 60 of the lifting member 12;
(d) the length of the dimension r (FIG. 6);
(e) the diameter of the cam axle (i.e., bolt 86); and
(f) the coefficient of friction of the cam 76 on its axle.

Providing sufficient torque to release the cam typically involves contributions from the following (not all-inclusive):

(a) the mass of the implement and any load thereon;
(b) the mass of the lifting member;
(c) the mass of any moving carriage on, e.g., a forklift vehicle to which the lifting member is mounted;
(d) dynamic forces arising from deceleration of the masses in (a)–(c), above, as the release lobe contacts the reference surface; and
(e) any powered downward force the forklift vehicle may provide to the lifting member.

It will also be appreciated that an additional contribution of torque to the release lobe can be applied by skidding the release lobe on the reference surface as the vehicle moves forward. Variables contributing to this additional torque are:

(a) coefficient of friction between the release lobe and the reference surface (roughness and surface irregularities on the reference surface can substantially affect this coefficient of friction);

(b) the vertical distance from the cam axis to the reference surface at the moment of contact of the release lobe with the reference surface;

(c) vertical forces as listed in (d) and (e) of the previous paragraph; and (d) the force with which the vehicle can move forward.

A disadvantage of having x be longer than necessary is that the cam must be made correspondingly larger. This may require a larger housing, if provided. In addition, a longer x results in a longer-extending release lobe, particularly whenever the cam is engaging a thin lifting member.

Practically speaking, the best way to determine the minimum length of x for a particular clamp according to the present invention is to experiment with differently sized cams in an intended operating environment. In view of the factors enumerated above and other information provided herein, it will be apparent to persons skilled in the art how to perform such tests.

Another advantage of the preferred cam embodiment shown in FIGS. 2–5 is that the vertically oriented release lobe is not prone to accumulation of debris thereon that otherwise could interfere with operation of the release lobe. In addition, the edge-surface profile of the release lobe is rounded which prevents the release lobe from becoming caught on obstacles.

In FIG. 2, the amount of cam rotation in a counterclockwise direction is limited by engagement of a lateral edge 104 of the cam against an edge 106 of the bottom panel 66. Whenever the contact edge 82 is engaging a lifting member 12 sufficiently thin to allow the lateral edge 104 of the cam to engage against the edge 106 as shown, the distance between O and P is at a maximum for the particular cam and, therefore, the cam cannot firmly engage a lifting member that is any thinner. It will be noted in FIG. 2 that the spiraled profile of the contact edge 82 does not extend any further around the engagement lobe 78 than would be useful whenever the lateral edge 104 of the cam is in contact with the edge 106.

In FIG. 2, the maximal range in which the cam 76 can pivot and still present at P a location on the contact edge 82 is termed the "fan angle" which is designated $\beta$. In the FIG. 2 embodiment, the fan angle $\beta$ is about 85°.

Figure 4:
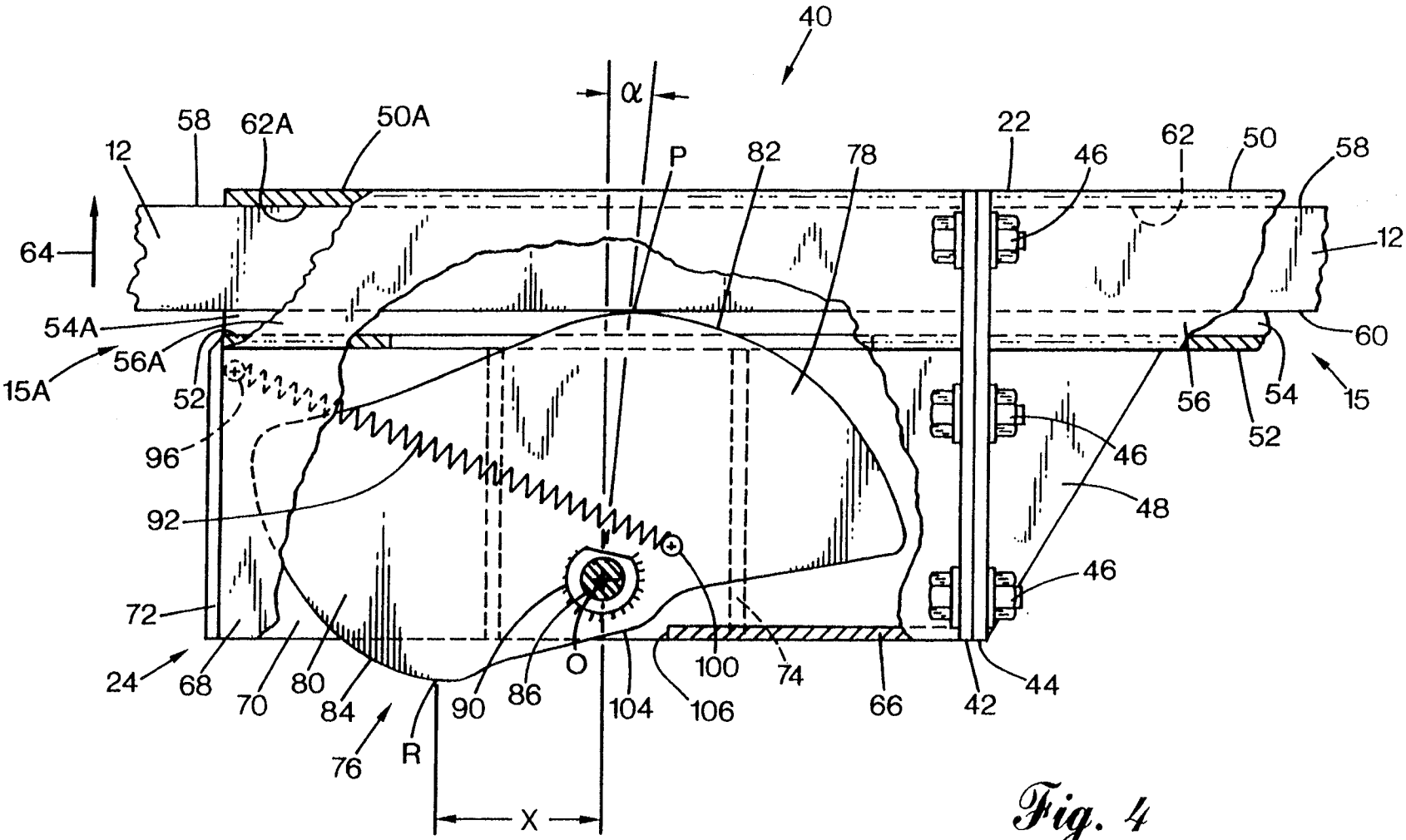
FIG. 4 is a side, partially cutaway, elevational view of the clamp of FIG. 2 engaging a thicker tine than shown in FIG. 2.

FIG. 4 shows the embodiment of FIGS. 2 and 3 in which the cam 76 is engaging a maximally thick tine 12 (compared to the maximally thin tine shown in FIGS. 2–3). Thus, in FIG. 4, the cam 76 has a more horizontal orientation compared to the cam position shown in FIG. 2 and the springs 92 are more extended in FIG. 4. Nevertheless, the contact edge 82 still engages the under-surface 60 of the lifting member 12 at the same contact angle $\alpha$. In addition, if the edge surface 84 of the release lobe 80 were allowed to contact a reference surface, such contact would occur at the same distance x relative to O.

Figure 5:
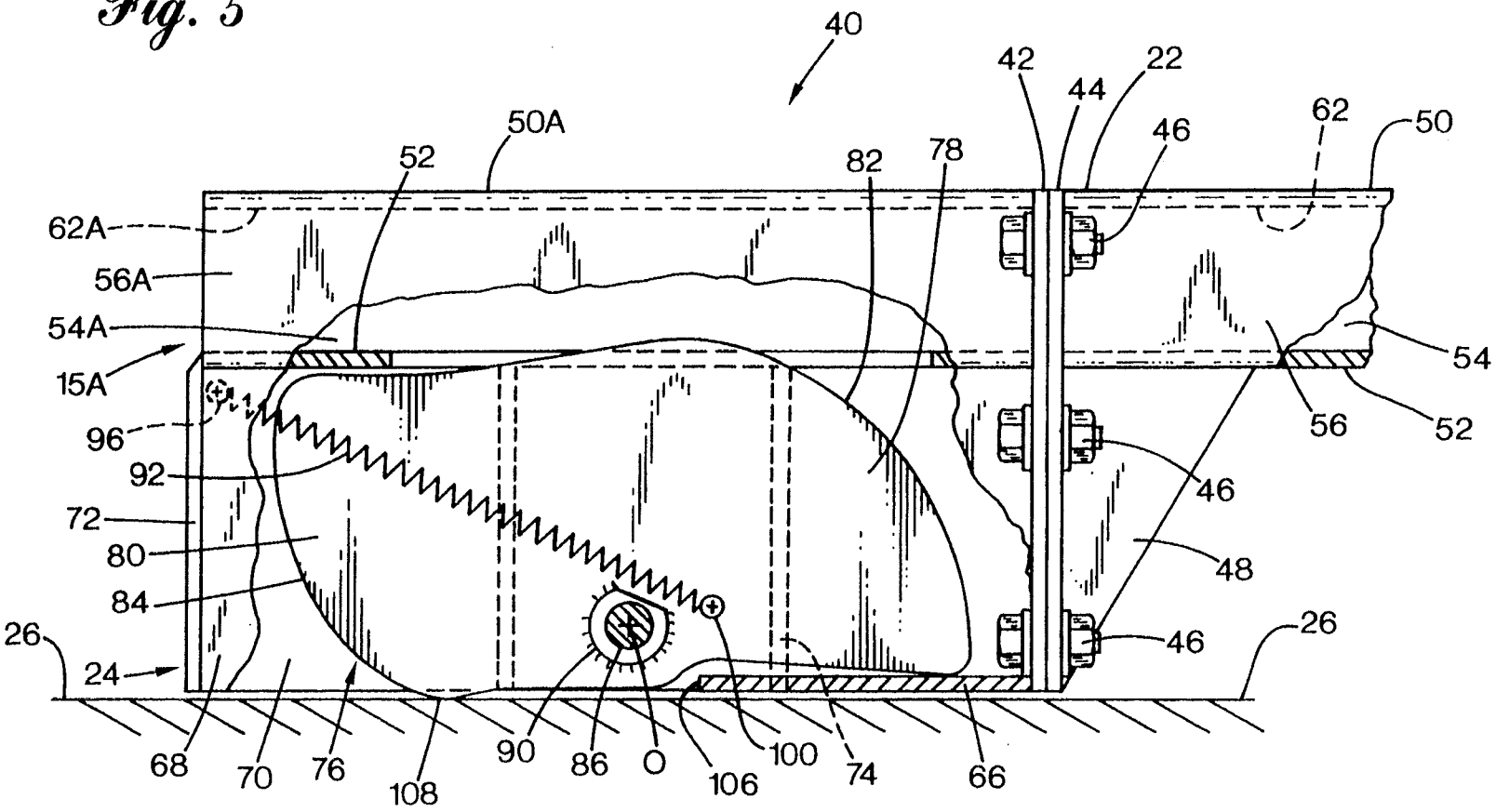
FIG. 5 is a side, partially cutaway, elevational view of the clamp of FIG. 2 resting upright on a reference surface.

FIG. 5 illustrates the clamp assembly 40 of FIGS. 2–4 resting on the reference surface 26 with the lifting member removed from the socket 15, 15A. On the cam 76, a nub 108 extending from an end of the edge surface 84 extends slightly out of the housing 24 to ensure that, when the clamp assembly 40 is resting upright on the reference surface 26, the cam is maximally rotated clockwise (in FIG. 5) to allow a lifting member to be freely inserted into or removed from the socket 15, 15A.

Whereas the cam shape shown in FIG. 2, for example, represents a preferred embodiment of the cam 76, other cam configurations are possible. For example, an alternative-embodiment cam need not have a release lobe that actually contacts the reference surface. Rather, cam embodiments are contemplated (not shown) that have a release lobe to which a separate "release member" or analogous component is pivotably mounted. Such a release member (e.g., a shaft having a first end pivotably mounted to the release lobe) would be adapted to extend under the influence of gravity or analogous force toward the reference surface and engage the reference surface whenever the clamp assembly is resting upright on the reference surface. Thus, such a release member would function in the same manner as the pendent shoe disclosed in U.S. Pat. No. 5,096,018 to Dickinson Jr., incorporated herein by reference.

In such alternative embodiments, the release lobe need not extend oppositely to the engagement lobe. For example, it is possible for a cam to be substantially "L"-shaped, wherein the pivot axis of the cam passes through the intersection of the horizontal and vertical legs of the "L"; the distal end of the vertical leg terminates with a contact edge having a spiraled profile to engage the under-surface of the lifting member at a contact angle $\alpha$; and the distal end of the horizontal leg has pivotably mounted thereto a pendent shoe or analogous release member adapted to extend toward a reference surface in a manner as disclosed in the aforementioned '018 patent to Dickenson Jr.

Also, instead of a release lobe 80 in fixed relationship to the engagement lobe, as shown in FIG. 2, it is possible to provide the cam with a ratcheted release mechanism coupled to and movable relative to the engagement lobe. Such a release mechanism would typically comprise a release member, such as a shaft, adapted to extend toward the reference surface. Contact of an end of such a release member with the reference surface would impart sufficient rotation, by way of the ratchet coupling of the release lobe to the engagement lobe, to pivot the engagement lobe away from the lifting member.

Of course, other mechanisms for causing the engagement lobe to release from the lifting member whenever the clamp is resting upright on the reference surface are possible (using known principles of machine design) and are therefore within the scope of the present invention.

Although the embodiment of FIGS. 2–5 has only one cam, clamp assemblies according to the present invention can also have multiple cams. If desired, the cams can be the same size for extra strength, stability, and/or redundancy of clamping action. Alternatively, the cams can be differently sized to permit a single clamp assembly to clamp a wider range of lifting-member thicknesses than a single-cam clamp assembly.

A representative multiple-cam embodiment is shown in FIGS. 7–11, wherein components identical to those shown in FIGS. 2–5 have the same reference designators.

FIGS. 7–11 also depict an alternative (and more preferred) way of attaching a clamp assembly to a socket than shown in FIGS. 2–5. Whereas, in FIGS. 2–5, the clamp assembly 40 is mounted to a socket 15 via a transverse mounting flange and actually comprises a socket portion 15A, the clamp assembly of FIGS. 7–11 lacks a socket portion and mounts directly to the underside of an existing socket either already situated beneath an implement (not shown) or adapted to be attached to an implement.

Figure 7:
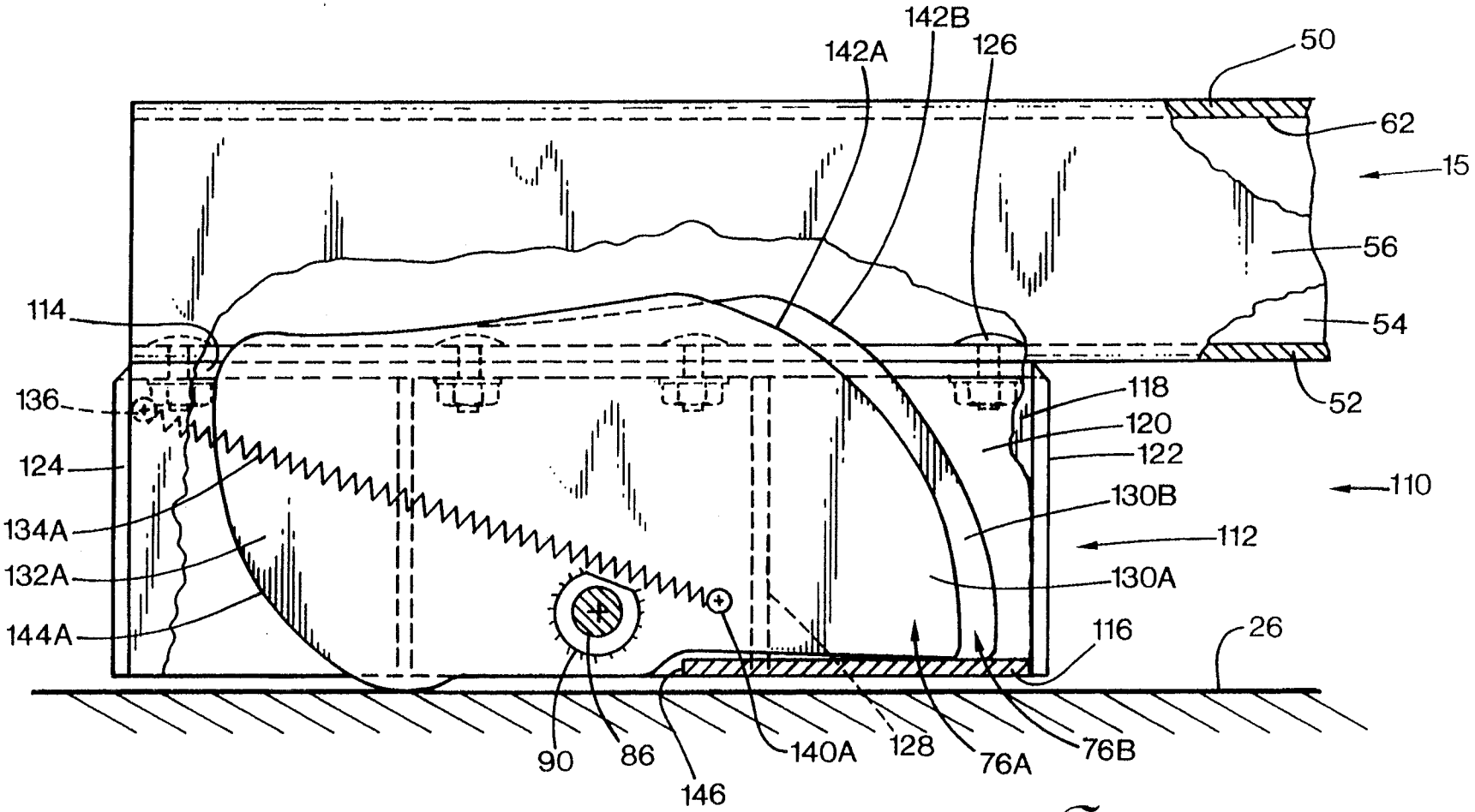
FIG. 7 is a side, partially cutaway, elevational view of a multiple-cam embodiment of a clamp according to the present invention adapted to be bolted to the underside of a tine socket, wherein the clamp is resting upright on a reference surface.
Figure 8:
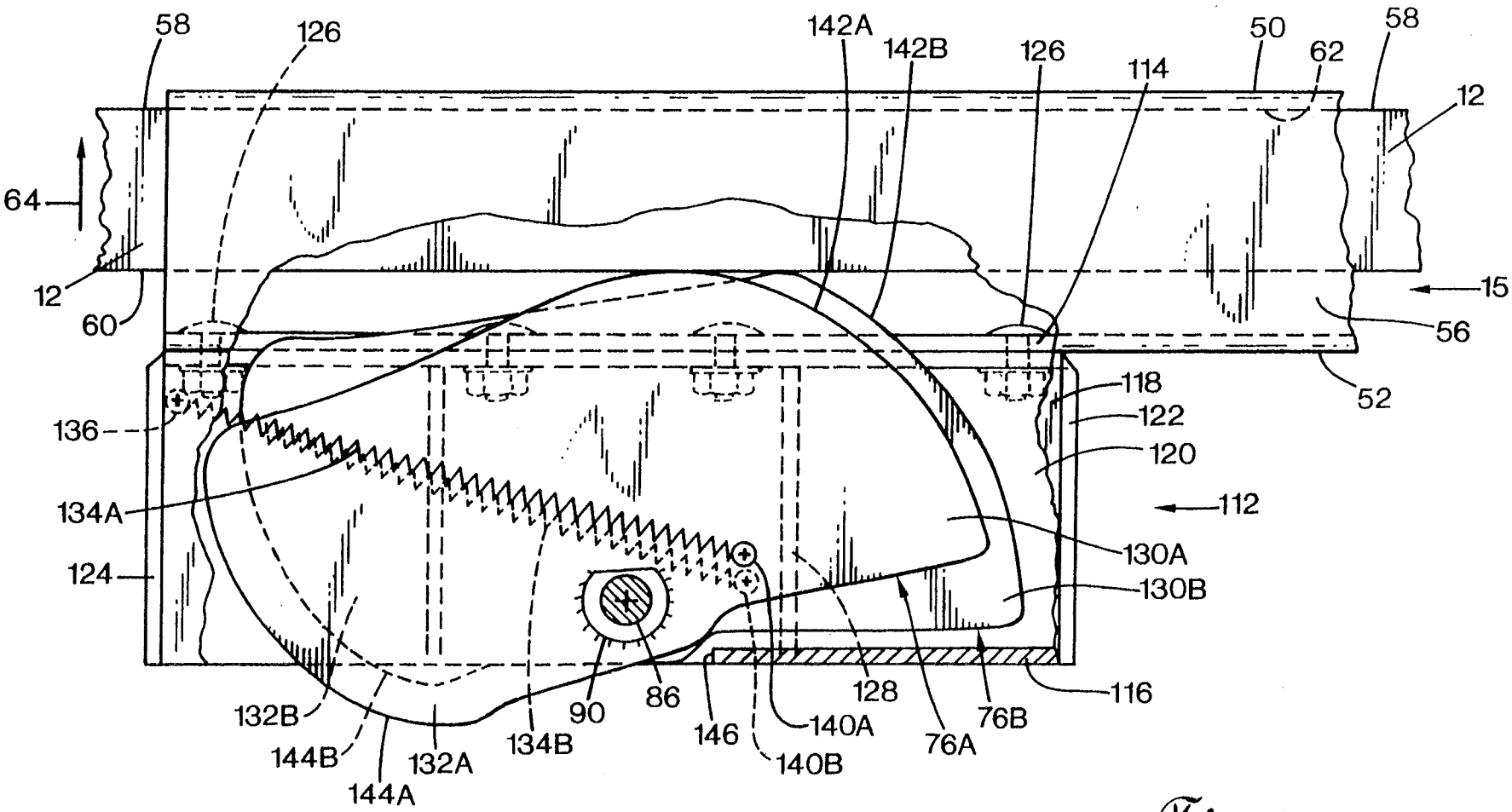
FIG. 8 is a side, partially cutaway, elevational view of the FIG. 7 embodiment engaging a thick tine.
Figure 11:
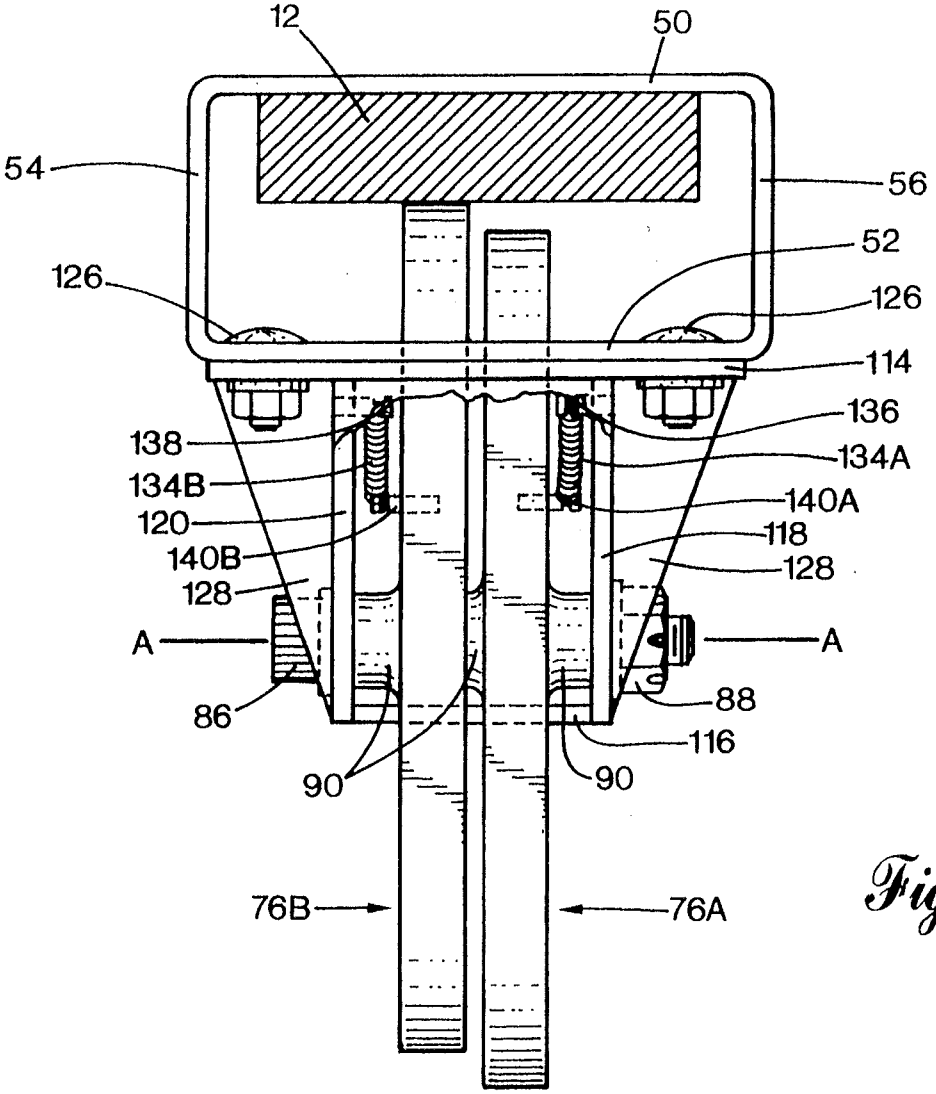
FIG. 11 is an end view of the clamp shown in FIG. 10 with a portion of an end panel of the clamp housing cut away to reveal interior details.

Turning first to FIG. 7, the clamp assembly 110 is shown resting upright on a reference surface 26. The clamp assembly 110 comprises a housing 112 that includes a top panel 114, a bottom panel 116, side panels 118, 120, and end panels 122, 124. A socket 15 is also shown comprising a first socket wall 50, a second socket wall 52, a first side wall 54, and a second side wall 56. The first socket wall 50 has an interior surface 62 adapted, as shown in FIG. 8, to contact the lifting surface 58 of a lifting member 12 whenever the lifting member is inserted into the socket 15 and the lifting member 12 is applying a net elevating force (arrow 64) to the socket 15 in an upright orientation. Thus, the interior surface 62 is a "working surface" as defined above. The housing 112 is mounted to the second socket wall 52 via bolts 126 passing through the second socket wall 52 and the top panel 114 (FIG. 11), or by other suitable fastening means in accordance with general principles of machine design. As shown in FIG. 11, the top panel 114 can be wider than the bottom panel 116 to provide sufficient land for the bolts 126. To form the housing 110, the panels 114, 116, 118, 120, 122, 124 are preferably welded together. Gussets 128 welded thereto provide additional rigidity and resistance to deformation to the housing 110.

As shown most clearly in FIG. 11, two cams 76A, 76B are provided, each at least partially enclosed within the housing 112. It is, of course, possible for the clamp assembly to comprise even more cams to provide a greater range of operability with lifting members of different thicknesses than the two-cam embodiment shown. As in the embodiment of FIGS. 2–5, the cams 76A, 76B shown in FIGS. 7–11 each comprise an engagement lobe 130A, 130B, respectively, and a release lobe 132A, 132B, respectively. The cams 76A, 76B are pivotably mounted to the housing 112 in a manner allowing the cams 76A, 76B to independently pivot about a single fixed transverse axis A (FIG. 11) extending through the side panels 118, 120. The axis A is fixed relative to the working surface 62. As shown best in FIGS. 10 and 11, the engagement lobes 130A, 130B are adapted to extend into the socket 15 toward the working surface 62 so as to be able to engage the under-surface 60 of the lifting member 12. As the engagement lobes thus extend into the socket 15, the release lobes 132A, 132B extend at least partially out of the socket 15 so as to be able to contact the reference surface should the clamp assembly 110 be lowered upright onto a reference surface.

The cams 76A, 76B are pivotably mounted to the side panels 118, 120 via a bolt 86 and nut 88 or other suitable fastening means that provides an axle (coaxial with the axis A) for the cams 76A, 76B. The cams 76A, 76B are preferably provided with integral shoulders 90 that provide proper spacing between the cams and increase the stability of the cams 76A, 76B on the bolt 86.

Passing the bolt 86 through the side panels 118, 120 serves to conveniently anchor the bolt and creates a fixed axis for the cam relative to the socket. This mounting arrangement also minimizes the number of parts. However, other ways to mount the bolt are possible, including providing a yoke or the like mounted to any of the panels comprising the housing 112 or to the socket.

The cams 76A, 76B are provided with bias means similar to the bias means of the single-cam embodiment of FIGS. 2–5. The bias means preferably comprises at least one extension spring 134A, 134B for each cam, as shown most clearly in FIG. 11. One end of each spring is coupled to a pin 136, 138, respectively, affixed to the corresponding side wall 118, 120, respectively, and an opposing end of each spring is coupled to a pin 140A, 140B, respectively, affixed to the corresponding cam. As discussed above, other bias means are also possible, including a reliance solely upon gravity.

The engagement lobe 130A, 130B of each cam 76A, 76B, respectively, defines a contact edge 142A, 142B, respectively, each having a profile shaped similarly to the contact edge 82 of the single-cam embodiment of FIGS. 2–5. For steel cams intended to engage a steel lifting member, the contact angle $\alpha$ (not shown) is preferably the same for each cam, typically within the range of greater than 0° and no greater than about 8°, and most preferably about 5°. The maximum and minimum radii of the contact edge 142A are smaller than the maximum and minimum radii, respectively, of the contact edge 142B. Preferably, the maximum radius of the contact edge 142A is slightly longer than the minimum radius of the contact edge 142B, thereby ensuring a small amount of overlap in the thicknesses of lifting members that can be engaged by each cam. Thus, the twin-cam embodiment shown in FIGS. 7–11 can clamp a range of lifting-member thicknesses slightly less than twice the range that can be clamped by a single-cam embodiment. The overlap ensures that all lifting-member thicknesses within the twin-cam range can be clamped by the twin-cam clamp assembly, even after the cams and/or the lifting members have experienced substantial wear.

The release lobe 132A, 132B of each cam 76A, 76B, respectively, also comprises a corresponding edge surface 144A, 144B that defines a spiral relative to the cam axis, as in the single-cam embodiment. The release lobes 132A, 132B function in exactly the same way as the release lobe in the single-cam embodiment. As most clearly shown in FIG. 7, the release lobes of both cams are preferably (but not necessarily) identical in size and shape.

Although the cams 76A, 76B of FIGS. 7–11 are shown each having a respective release lobe 132A, 132B, other embodiments (not shown) are possible. For example, if only a first cam were provided with a release lobe, the second cam could be provided with a projection or analogous feature extending to the first cam and adapted to engage a slot in or projection from the first cam serving to "release" the first cam in addition to the second cam whenever the clamp assembly is placed upright on a reference surface.

As in the single-cam embodiment, the amount of cam rotation in a counterclockwise direction (in the views of FIGS. 7–10) is limited by an edge 146.

Figure 9:
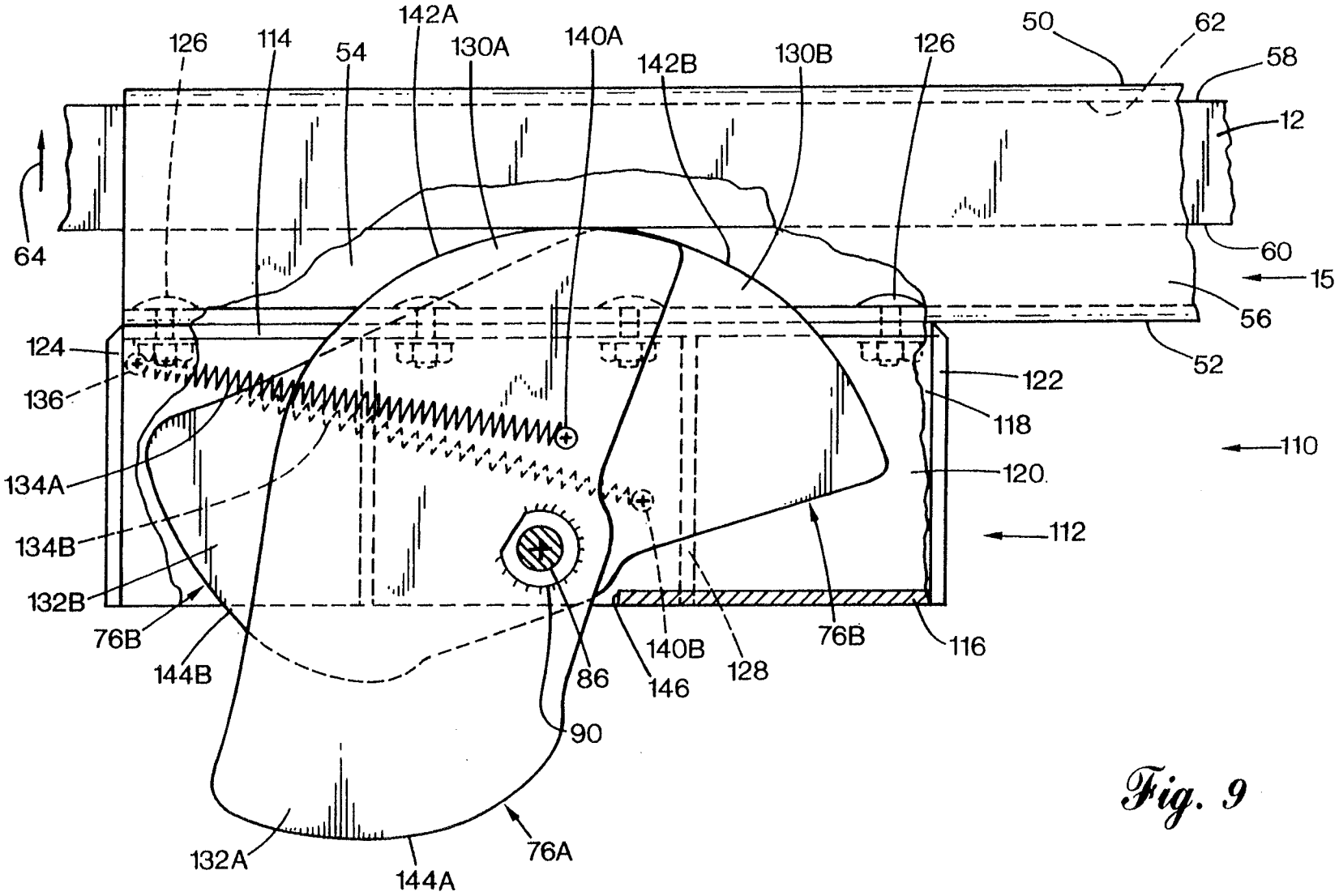
FIG. 9 is a side, partially cutaway, elevational view of the FIG. 7 embodiment engaging a tine of medium thickness.
Figure 10:
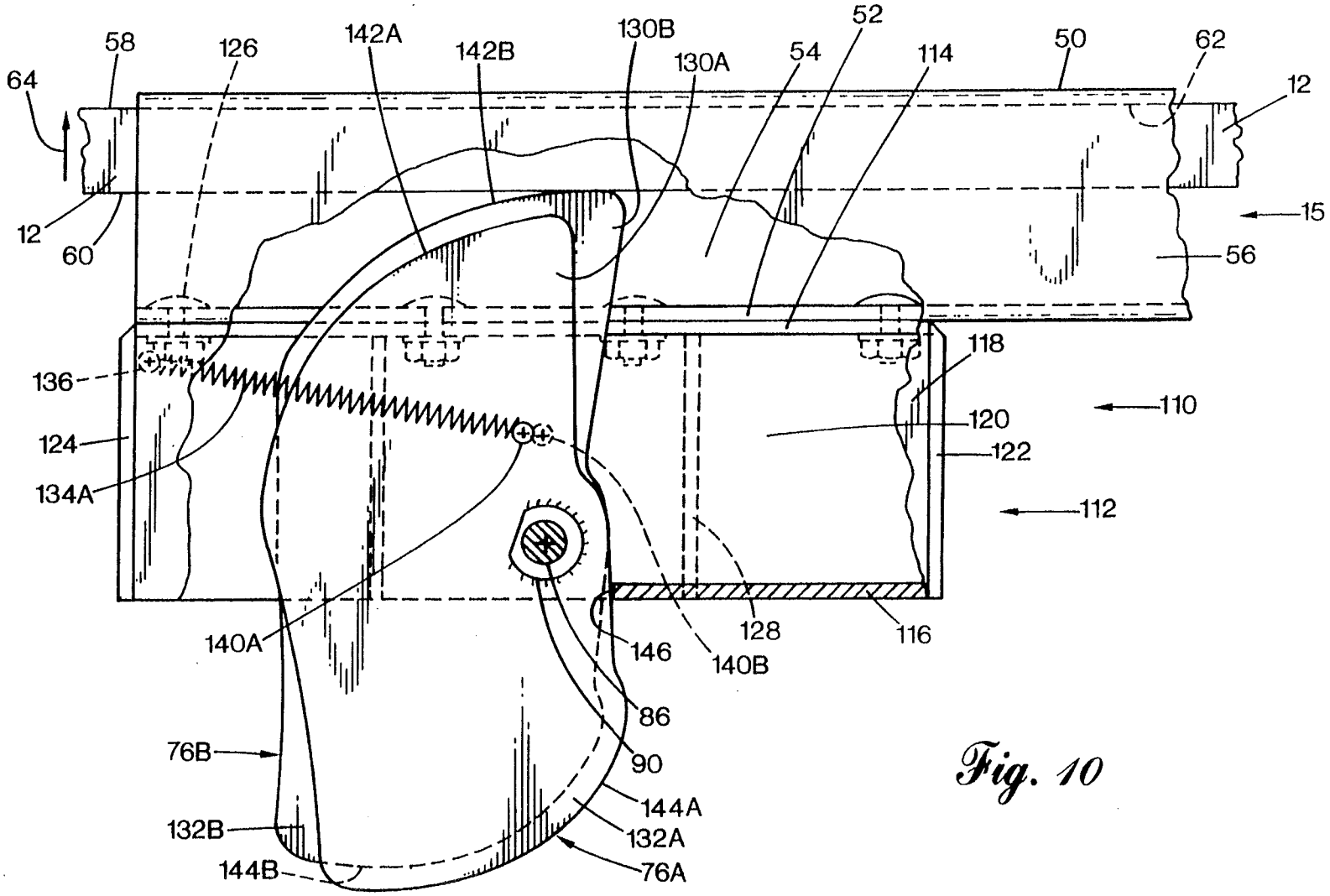
FIG. 10 is a side, partially cutaway, elevational view of the FIG. 7 embodiment engaging a thin tine.

FIGS. 7–10 depict, as a sequence, various positions of the cams relative to each other, depending upon whether or not the clamp assembly is resting on the reference surface (FIG. 7) or upon the thickness of the lifting member inserted into the socket (FIGS. 8–10). In FIG. 7, the cams 76A, 76B are shown in an orientation occurring whenever the clamp assembly 110 is resting upright on the reference surface 26. As can be seen, the cams 76A, 76B are in a fully "retracted" position allowing a lifting member (not shown) to be freely inserted into and removed from the socket 15. In addition, each spring 134A, 134B is fully extended. In FIG. 8, a maximally thick lifting member 12 has been inserted into the socket 15 and the lifting member 12 has elevated (arrow 64) the clamp assembly 110 off the reference surface (not shown). The contact edge 142A of the smaller cam 76A has engaged the under-surface 60 of the lifting member 12, but the lifting member 12 is too thick to allow engagement of the contact edge 142B of the larger cam 76B. In FIG. 9, a thinner lifting member 12 has been inserted into the socket 15 and the lifting member 12 has elevated (arrow 64) the clamp assembly 110 off the reference surface (not shown). Now, whereas the smaller cam 76A has almost rotated a maximal amount in the clockwise direction as its contact surface 142A still engages the under-surface 60 of the lifting member, the contact surface 142B of the larger cam 76B is just beginning to engage the under-surface 60 of the lifting member 12. In FIG. 10, a still thinner lifting member 12 has been inserted into the socket 15 and the lifting member 12 has elevated (arrow 64) the clamp assembly 110 off the reference surface (not shown). Now, the smaller cam **76*a* can no longer engage the under-surface 60 of the lifting member 12 and has pivoted counterclockwise sufficiently to be stopped by the edge 146. Meanwhile, the contact surface 142B of the larger cam 76B is still engaging the under-surface 60 of the lifting member 12 sufficiently to prevent the lifting member 12 from being withdrawn from the socket 15. In FIG. 11, an end view of FIG. 10, it can be seen that the smaller cam is not contacting the lifting member 12** at all.

Figure 12:
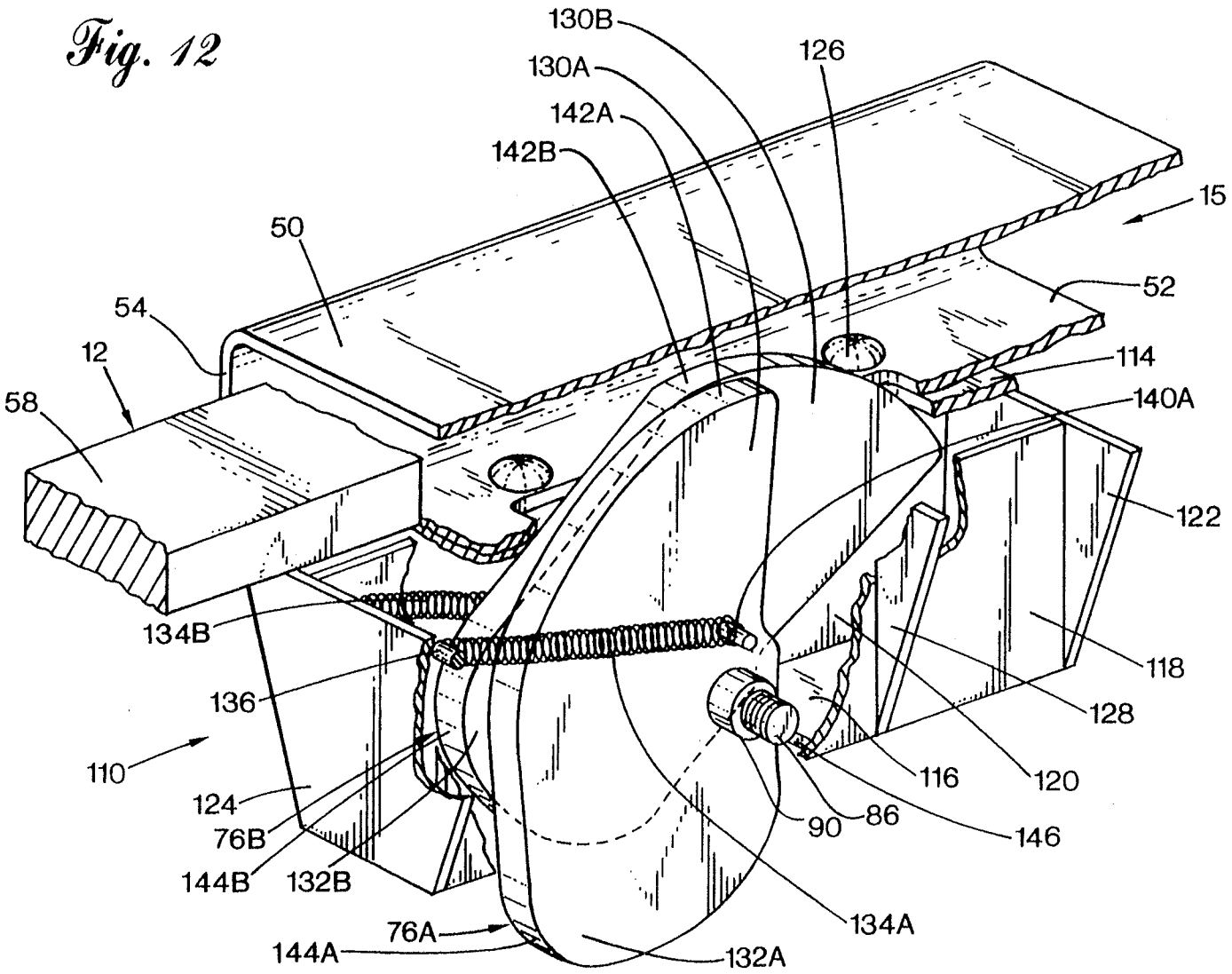
FIG. 12 is a perspective view of the multi-cam embodiment shown in FIG. 9.

To further illustrate the present invention, FIG. 12 shows in perspective the clamp embodiment depicted in FIGS. 7–11. The same reference designators as used in FIGS. 7–11 are used in FIG. 12.

Although we have described and shown in the foregoing description two possible ways in which the clamp can be attached to the socket, it will be understood that any of various other attachment schemes can be employed that are within the purview of persons possessing skill in machine design. For example, instead of the "transverse-flange" scheme shown in FIGS. 2–5, an analogous "horizontal-flange" mounting can also be used, by which the clamp is mounted to the underside of a socket rather than to an end of the socket. It is also possible to eliminate flanges and mounting bolts entirely by an "integrated" clamp-socket assembly wherein the clamp is constructed directly on the underside of the socket, such as by welding. Combinations of various mounting schemes are also within the scope of the present invention.

If the implement is provided with open-bottomed inverted channels instead of fully enclosed sockets for receiving the lifting member, it will be appreciated that such an implement can be readily provided with a clamp according to the present invention. In such an instance, each channel would comprise a base and two opposing side walls. In a typical installation on an implement, the channels would be mounted with the side walls extending downward beneath the base panel or floor of the implement. Thus, the base of each inverted channel serves as a "first socket wall" and, when the implement is elevated by the lifting member, the lifting surface of the lifting member contacts the base of the corresponding channel (wherein the base of the channel provides a "working surface"). Opposing brackets can be mounted to the side walls of each channel to provide a way to pivotably mount the cam on a fixed axis relative to the corresponding working surface. Thus, in such a configuration, although there is no "second socket wall" each channel with its side walls provides a way to position the lifting member relative to the cam so as to ensure that the lifting member will be engaged by the cam whenever the lifting member is being used to elevate the implement.

It will also be apparent to persons skilled in the art that a clamp according to the present invention can be provided on an implement having a base panel or floor but no socket or channel whatsoever for the lifting member when the implement is elevated by the lifting member. In such an instance, the base panel or floor of the implement serves as the "first socket wall" and, when the implement is elevated by the lifting member, the under-surface of the base panel (serving as the "working surface" is contacted by the lifting surface of the lifting member. According to the present invention, a set of opposing brackets mounted to and extending downward from the under-surface of the base panel can provide a way to pivotably mount the cam on a fixed axis relative to the working surface. In such a configuration, there is no "second socket wall". Each set of opposing brackets and the corresponding region of the base panel flanked by the set of brackets effectively define a "channel" adapted to receive the lifting member. Thus, so long as the lifting member is inserted into the corresponding "channel", the lifting member will be engaged by the cam whenever the lifting member is being used to elevate the implement. Alternatively, one or more assemblies according to the present invention comprising a combination of a socket and a clamp as disclosed above can simply be attached to the under-surface of the base panel or floor of the implement.

In view of the foregoing, it will be appreciated that a "socket" need not be enclosed by first and second socket walls and first and second side walls. A "socket" can be any feature adapted to receive a rigid, longitudinally extended lifting member so as to advantageously position the lifting member for elevating the socket and anything (such as an implement) to which the socket is attached.

Having illustrated and described the principles of the invention in several preferred and alternative embodiments, it should be apparent to those skilled in the art that the invention can be modified in arrangement and detail without departing from such principles. I claim all modifications coming within the spirit and scope of the following claims.

We claim:

1. A clamp for gripping a rigid longitudinally extended lifting member having a lifting surface and an opposing under-surface, the clamp comprising:

a working surface that contacts at least a portion of the lifting surface whenever the lifting member is being used to elevate the clamp off a reference surface; and a cam mounted for rotation about an axis that is fixed relative to the working surface, the cam being positioned such that, whenever the lifting member is being used to elevate the clamp off the reference surface, the lifting member is situated between the cam and the working surface, the cam comprising an engagement lobe defining a contact edge having an outwardly radiating spiraled profile relative to the axis, the engagement lobe extending, whenever the clamp is not resting upright on the reference surface, toward the working surface so as to allow a location on the contact edge to engage the under-surface of the lifting member and self-lock against said under-surface whenever the lifting surface is in contact with the working surface and the lifting member is being used to elevate the clamp off the reference surface, the cam being rotatable about the axis so as to apply a force against the under-surface of the lifting member that presses the lifting surface against the working surface whenever the lifting member has elevated the clamp off the reference surface and the clamp is being urged to move forwardly on the lifting member but not when the clamp is being urged to move rearwardly on the lifting member, the force having a magnitude that correspondingly increases whenever the clamp is being urged more strongly to move forwardly on the lifting member.

2. A clamp as recited in claim 1 further comprising bias means for applying a force urging the cam to rotate about the axis sufficiently to maintain the engagement lobe oriented toward the working surface whenever the clamp is not resting upright on the reference surface so as to ensure engagement of the contact edge with the under-surface of the lifting member whenever the lifting member is being used to elevate the clamp off the reference surface.

3. A clamp as recited in claim 2 further comprising means for releasing engagement of the contact edge with the under-surface of the lifting member whenever the clamp is resting upright on the reference surface.

4. A clamp for gripping a rigid longitudinally extended lifting member having a lifting surface and an opposing under-surface, the clamp comprising:

a working surface that contacts at least a portion of the lifting surface whenever the lifting member is being used to elevate the clamp off a reference surface; and a cam mounted for rotation about an axis, the cam being positioned such that, whenever the lifting member is being used to elevate the clamp off the reference surface, the lifting member is situated between the cam and the working surface, the cam comprising an engagement lobe defining a contact edge having an outwardly radiating spiraled profile relative to the axis, the engagement lobe extending, whenever the clamp is not resting upright on the reference surface, toward the working surface so as to allow a location on the contact edge to engage the under-surface of the lifting member and self-lock against said under-surface whenever the lifting surface is in contact with the working surface and the lifting member is being used to elevate the clamp off the reference surface, the cam being rotatable about the axis so as to apply a force against the under-surface of the lifting member that presses the lifting surface against the working surface whenever the lifting member has elevated the clamp off the reference surface and the clamp is being urged to move forwardly on the lifting member but not when the clamp is being urged to move rearwardly on the lifting member, the force having a magnitude that correspondingly increases whenever the clamp is being urged more strongly to move forwardly on the lifting member.

5. A clamp as recited in claim 4 further comprising bias means for applying a force urging the cam to rotate about the axis sufficiently to maintain the engagement lobe oriented toward the working surface whenever the clamp is not resting upright on the reference surface so as to ensure engagement of the contact edge with the under-surface of the lifting member whenever the lifting member is being used to elevate the clamp off the reference surface.

6. A clamp as recited in claim 5 further comprising means for releasing engagement of the contact edge with the under-surface of the lifting member whenever the clamp is resting upright on the reference surface.

7. A clamp for gripping a rigid longitudinally extended lifting member having a lifting surface and an opposing under-surface, the clamp comprising:

a working surface that contacts at least a portion of the lifting surface whenever the lifting member is being used to elevate the clamp off a reference surface; and a cam mounted for rotation about an axis, the cam being positioned such that, whenever the lifting member is being used to elevate the clamp off the reference surface, the lifting member is situated between the cam and the working surface, the cam comprising an engagement lobe defining a contact edge having an outwardly radiating spiraled profile relative to the axis, the engagement lobe extending, whenever the clamp is not resting upright on the reference surface, toward the working surface so as to allow a location on the contact edge to engage the under-surface of the lifting member and self-lock against said under-surface at a contact angle whenever the lifting surface is in contact with the working surface and the lifting member is being used to elevate the clamp off the reference surface, the contact angle being substantially constant independently of how the cam is oriented on the axis as the contact edge engages the under-surface of the lifting member, the cam being rotatable about the axis so as to apply a force against the under-surface of the lifting member that presses the lifting surface against the working surface whenever the lifting member has elevated the clamp off the reference surface and the clamp is being urged to move forwardly on the lifting member but not when the clamp is being urged to move rearwardly on the lifting member, the force having a magnitude that correspondingly increases whenever the clamp is being urged more strongly to move forwardly on the lifting member.

8. A clamp as recited in claim 7 further comprising bias means for applying a force urging the cam to rotate about the axis sufficiently to maintain the engagement lobe oriented toward the working surface whenever the clamp is not resting upright on the reference surface so as to ensure engagement of the contact edge with the under-surface of the lifting member whenever the lifting member is being used to elevate the clamp off the reference surface.

9. A clamp as recited in claim 8 further comprising means for releasing engagement of the contact edge with the under-surface of the lifting member whenever the clamp is resting upright on the reference surface.

10. A clamp for gripping a rigid longitudinally extended lifting member having a lifting surface and an opposing under-surface, the clamp comprising:

a working surface that contacts at least a portion of the lifting surface whenever the lifting member is being used to elevate the clamp off a reference surface; and a cam mounted for rotation about an axis that is fixed relative to the working surface, the cam being positioned such that, whenever the lifting member is being used to elevate the clamp off the reference surface, the lifting member is situated between the cam and the working surface, the cam comprising an engagement lobe defining a contact edge having an outwardly radiating spiraled profile relative to the axis, the engagement lobe extending, whenever the clamp is not resting upright on the reference surface, toward the working surface so as to allow a location on the contact edge to engage the under-surface of the lifting member at a contact angle whenever the lifting surface is in contact with the working surface and the lifting member is being used to elevate the clamp off the reference surface, the contact angle being substantially constant independently of how the cam is oriented on the axis as the contact edge engages the under-surface of the lifting member, the cam being rotatable about the axis so as to apply a force against the under-surface of the lifting member that presses the lifting surface against the working surface whenever the lifting member has elevated the clamp off the reference surface and the clamp is being urged to move forwardly on the lifting member but not when the clamp is being urged to move rearwardly on the lifting surface, the force having a magnitude and being defined by a vector $F_S$ that remains oriented on a line perpendicular to the axis and passing through the location on the contact edge regardless of the magnitude of $F_S$ which correspondingly increases whenever the clamp is being urged more strongly to move forwardly on the lifting member.

11. A clamp as recited in claim 10 further comprising bias means for applying a force urging the cam to rotate about the axis sufficiently to maintain the engagement lobe oriented toward the working surface whenever the clamp is not resting upright on the reference surface so as to ensure engagement of the contact edge with the under-surface of the lifting member whenever the lifting member is being used to elevate the clamp off the reference surface.

12. A clamp as recited in claim 11 further comprising means for releasing engagement of the contact edge with the under-surface of the lifting member whenever the clamp is resting upright on the reference surface.

13. A clamp for gripping a rigid longitudinally extended lifting member having a lifting surface and an opposing under-surface, the clamp comprising:

a working surface that contacts at least a portion of the lifting surface whenever the lifting member is being used to elevate the clamp off a reference surface; and a first cam mounted for rotation about an axis that is fixed relative to the working surface, the first cam being positioned such that, whenever the lifting member is being used to elevate the clamp off the reference surface, the lifting member is situated between the first cam and the working surface, the first cam comprising an engagement lobe defining a contact edge having an outwardly radiating spiraled profile relative to the axis in a plane perpendicular to the axis, the engagement lobe extending, whenever the clamp is not resting upright on the reference surface, toward the working surface so as to allow a location on the contact edge to engage the under-surface of the lifting member at a contact angle and self-lock against said under-surface whenever the lifting surface is in contact with the working surface and the lifting member is being used to elevate the clamp off the reference surface, the first cam being rotatable about the axis so as to apply a force against the under-surface of the lifting member serving to press the lifting surface against the working surface whenever the lifting member has elevated the clamp off the reference surface and the clamp is being urged to move forwardly on the lifting member but not when the clamp is being urged to move rearwardly on the lifting member, the contact angle being substantially constant independently of how the first cam is oriented on the axis as the contact edge engages the under-surface of the lifting member, the force having a magnitude and being defined by a vector $F_S$ that remains oriented on a line perpendicular to the axis and passing through the location on the contact edge regardless of the magnitude of $F_S$ which correspondingly increases whenever the clamp is being urged more strongly to move forwardly off the lifting member; and first bias means for applying a force urging the first cam to rotate about the axis sufficiently to maintain the engagement lobe oriented toward the working surface whenever the clamp is not resting upright on the reference surface so as to ensure engagement of the contact edge with the under-surface of the lifting member whenever the lifting member is being used to elevate the clamp off the reference surface.

14. A clamp as recited in claim 13 further comprising means for releasing engagement of the contact edge with the under-surface of the lifting member whenever the clamp is resting upright on the reference surface.

15. A clamp as recited in claim 14 wherein said means for releasing engagement of the contact edge comprises a release lobe on the first cam, the release lobe defining an edge surface the contacts the reference surface and causes the first cam to rotate about the axis against the force applied to the first cam by said first bias means whenever the clamp is resting upright on the reference surface.

16. A clamp as recited in claim 15 wherein the release lobe defines a lever arm for the first cam relative to the axis, the lever arm being of a constant length independently of the orientation of the first cam as the edge surface contacts the reference surface.

17. A clamp as recited in claim 13 wherein the contact edge defines a logarithmic spiral relative to the axis.

18. A clamp as recited in claim 13 wherein the contact edge and lifting member are steel and the contact angle is greater than 0° but no greater than 8°.

19. A clamp as recited in claim 13 wherein said first bias means comprises at least one extension spring having a first end coupled to a fixed support and a second end coupled to the first cam.

20. A clamp as recited in claim 13 further comprising a housing enclosing at least the engagement lobe of the first cam.

21. A clamp as recited in claim 13 further comprising a second cam mounted for rotation about the axis, the second cam having an engagement lobe defining a contact edge having an outwardly radiating spiraled profile relative to the axis in a plane perpendicular to the axis, the engagement lobe of the second cam extending, whenever the clamp is not resting upright on the reference surface, toward the working surface so as to allow a location on the contact edge of the second cam to engage the under-surface of a lifting member at a contact angle and self-lock against said under-surface whenever the lifting surface is in contact with the working surface and the lifting member is being used to elevate the clamp off a reference surface, the contact angle being substantially constant independently of how the second cam is oriented on the axis as the contact edge of the second cam engages the under-surface of the lifting member, the second cam being rotatable about the axis so as to apply a force against the under-surface of the lifting member that presses the lifting surface against the working surface whenever the lifting member has elevated the clamp off the reference surface and the clamp is being urged to move forwardly on the lifting member but not when the clamp is being urged to move rearwardly on the lifting member, the force having a magnitude that correspondingly increases whenever the clamp is being urged more strongly to move forwardly on the lifting member; and second bias means for applying a force urging the second cam to rotate about the axis sufficiently to maintain the engagement lobe of the second cam oriented toward the working surface whenever the clamp is not resting upright on the reference surface so as to ensure engagement of the contact edge of the second cam with the under-surface of the lifting member whenever the lifting member is being used to elevate the clamp off the reference surface.

22. A clamp as recited in claim 21 wherein the engagement lobe of the first cam can engage a first range of lifting-member thicknesses and the second cam comprises an engagement lobe that can engage a second range of lifting-member thicknesses.

23. A clamp as recited in claim 22 wherein the second range of lifting-member thicknesses overlaps but does not encompass the first range of lifting-member thicknesses.

24. A clamp that is mountable to a socket for receiving an elongated lifting member therein for elevating the socket and anything to which the socket is attached off a reference surface, the lifting member having a lifting surface and an under-surface opposite the lifting surface, and the socket including a working surface that contacts at least a portion of the lifting surface whenever the lifting member is in the socket and is being used to elevate the socket off the reference surface, the clamp comprising:

a cam mounted to the socket to permit rotation of the cam about an axis that is fixed relative to the working surface and transverse to but spaced apart from the working surface such that, whenever the lifting member is inserted into the socket, the lifting member is situated between the cam and the working surface, the cam comprising an engagement lobe defining a contact edge having an outwardly radiating spiraled profile relative to the axis, the engagement lobe extending, whenever the socket is not resting upright on the reference surface, toward the working surface so as to allow a location on the contact edge to engage the under-surface of the lifting member and self-lock against said under-surface whenever the lifting surface is in contact with the working surface and the lifting member is being used to elevate the socket off the reference surface, the cam being rotatable about the axis so as to apply a force against the under-surface of the lifting member serving to press the lifting surface against the working surface whenever the lifting member has elevated the socket off the reference surface and the socket is being urged to move forwardly on the lifting member but not when the socket is being urged to move rearwardly on the lifting member, the force having a magnitude that correspondingly increases whenever the socket is being urged more strongly to move forwardly on the lifting member.

25. A clamp as recited in claim 24 further comprising bias means for applying a force urging the cam to rotate about the axis sufficiently to maintain the engagement lobe oriented toward the working surface whenever the clamp is not resting upright on the reference surface so as to ensure engagement of the contact edge with the under-surface of the lifting member whenever the lifting member is being used to elevate the clamp off the reference surface.

26. A clamp as recited in claim 24 further comprising means for releasing engagement of the contact edge with the under-surface of the lifting member whenever the clamp is resting upright on the reference surface.

27. A clamp that is mountable to a socket for receiving an elongated lifting member therein for elevating the socket and anything to which the socket is attached off a reference surface, the lifting member having a lifting surface and an under-surface opposite the lifting surface, and the socket including a working surface that contacts at least a portion of the lifting surface of the lifting member whenever the lifting member is in the socket and is being used to elevate the socket off the reference surface, the clamp comprising:

a cam mounted to the socket to permit rotation of the cam about an axis that is fixed relative to the working surface and transverse to but spaced apart from the working surface such that, whenever the lifting member is inserted into the socket, the lifting member is situated between the cam and the working surface, the cam comprising an engagement lobe defining a contact edge having an outwardly radiating spiraled profile relative to the axis, the engagement lobe extending, whenever the socket is not resting upright on the reference surface, toward the working surface so as to allow a location on the contact edge to engage the under-surface of the lifting member at a contact angle whenever the lifting surface is in contact with the working surface and the lifting member is being used to elevate the socket off the reference surface, the cam being rotatable about the axis so as to self-lock against and thus apply a force against said under-surface serving to press the lifting surface against the working surface whenever the lifting member has elevated the socket off the reference surface and the socket is being urged to move forwardly on the lifting member but not when the socket is being urged to move rearwardly on the lifting member, the contact angle being substantially constant independently of how the cam is oriented on the axis as the contact edge engages the under-surface of the lifting member, and the force having a magnitude that correspondingly increases whenever the socket is being urged more strongly to move forwardly on the lifting member.

28. A clamp as recited in claim 27 further comprising bias means for applying a force urging the cam to rotate about the axis sufficiently to maintain the engagement lobe oriented toward the working surface whenever the clamp is not resting upright on the reference surface so as to ensure engagement of the contact edge with the under-surface of the lifting member whenever the lifting member is being used to elevate the clamp off the reference surface.

29. A clamp as recited in claim 27 further comprising means for releasing engagement of the contact edge with the under-surface of the lifting member whenever the clamp is resting upright on the reference surface.

30. A clamp that is mountable to a socket for receiving an elongated lifting member therein for lifting the socket and anything to which the socket is attached off a reference surface, the lifting member having a lifting surface and an under-surface opposite the lifting surface, and the socket including a working surface that contacts at least a portion of the lifting surface whenever the lifting member is in the socket and is being used to elevate the socket off the reference surface, the clamp comprising:

a cam mounted to the socket to permit rotation of the cam about an axis that is fixed relative to the working surface and transverse to but spaced apart from the working surface such that, whenever the lifting member is inserted into the socket, the lifting member is situated between the cam and the working surface, the cam comprising an engagement lobe defining a contact edge having an outwardly radiating spiraled profile relative to the axis, the engagement lobe extending, whenever the socket is not resting upright on the reference surface, toward the working surface so as to allow a location on the contact edge to engage the under-surface of the lifting member at a contact angle whenever the lifting surface is in contact with the working surface and the lifting member is being used to elevate the socket off the reference surface, the contact angle being substantially constant independently of how the cam is oriented on the axis as the contact edge engages the under-surface of the lifting member, the cam being rotatable about the axis so as to self-lock against and thug apply a force against the under-surface of the lifting member serving to press the lifting surface against the working surface whenever the lifting member has elevated the socket off the reference surface and the socket is being urged to move forwardly on the lifting member but not when the socket is being urged to move rearwardly on the lifting member, the force having a magnitude and being defined by a vector $F_S$ that remains oriented on a line perpendicular to the axis and passing through the location on the contact edge regardless of the magnitude of $F_S$ which correspondingly increases whenever the socket is being urged more strongly to move forwardly on the lifting member.

31. A clamp as recited in claim 30 further comprising bias means for applying a force urging the cam to rotate about the axis sufficiently to maintain the engagement lobe oriented toward the working surface whenever the clamp is not resting upright on the reference surface so as to ensure engagement of the contact edge with the under-surface of the lifting member whenever the lifting member is being used to elevate the clamp off the reference surface.

32. A clamp as recited in claim 30 further comprising means for releasing engagement of the contact edge with the under-surface of the lifting member whenever the clamp is resting upright on the reference surface.

33. A clamp for receiving and gripping a rigid longitudinally extended lifting member having a lifting surface and an opposing under-surface, the clamp comprising:

a socket that longitudinally receives the lifting member, the socket comprising a working surface that contacts at least a portion of the lifting surface whenever the lifting member is being used to elevate the clamp off a reference surface; and a cam mounted to the socket to permit rotation of the cam about an axis that is transverse to the socket and spaced apart from and fixed relative to the working surface such that, whenever the lifting member is inserted into the socket, the lifting member is situated between the cam and the working surface, the cam comprising an engagement lobe defining a contact edge having an outwardly radiating spiraled profile relative to the axis, the engagement lobe extending, whenever the socket is not resting upright on the reference surface, toward the working surface so as to allow a location on the contact edge to engage the under-surface of the lifting member whenever the lifting surface is in contact with the working surface and the lifting member is being used to elevate the socket off the reference surface, the cam being rotatable about the axis so as to self-lock against and thus apply a force against the under-surface of the lifting member that presses the lifting surface against the working surface whenever the lifting member has elevated the socket off the reference surface and the socket is being urged to move forwardly on the lifting member but not when the socket is being urged to move rearwardly on the lifting member, the force having a magnitude that correspondingly increases whenever the socket is being urged more strongly to move forwardly on the lifting member.

34. A clamp as recited in claim 33 further comprising bias means for applying a force urging the cam to rotate about the axis sufficiently to maintain the engagement lobe oriented toward the working surface whenever the clamp is not resting upright on the reference surface so as to ensure engagement of the contact edge with the under-surface of the lifting member whenever the lifting member is being used to elevate the clamp off the reference surface.

35. A clamp as recited in claim 33 further comprising means for releasing engagement of the contact edge with the under-surface of the lifting member whenever the clamp is resting upright on the reference surface.

36. A clamp for receiving and gripping a rigid longitudinally extended lifting member having a lifting surface and an opposing under-surface, the clamp comprising:

a socket that longitudinally receives the lifting member, the socket comprising a working surface that contacts at least a portion of the lifting surface of the lifting member whenever the lifting member is being used to elevate the clamp off a reference surface; and a cam mounted to the socket to permit rotation of the cam about an axis that is transverse to the socket and spaced apart from the working surface, the cam being positioned such that, whenever the lifting member is being used to elevate the socket off the reference surface, the lifting member is situated between the cam and the working surface, the cam comprising an engagement lobe defining a contact edge having an outwardly radiating spiraled profile relative to the axis, the engagement lobe extending, whenever the socket is not resting upright on the reference surface, toward the working surface so as to allow a location on the contact edge to engage the under-surface of the lifting member and self-lock against said under-surface at a contact angle whenever the lifting surface is in contact with the working surface and the lifting member is being used to elevate the socket off the reference surface, the contact angle being substantially constant independently of how the cam is oriented on the axis as the contact edge engages the under-surface of the lifting member, the cam being rotatable about the axis so as to apply a force against the under-surface of the lifting member that presses the lifting surface against the working surface whenever the lifting member has elevated the socket off the reference surface and the socket is being urged to move forwardly on the lifting member but not when the socket is being urged to move rearwardly on the lifting member, the force having a magnitude that correspondingly increases whenever the socket is being urged more strongly to move forwardly on the lifting member.

37. A clamp as recited in claim 36 further comprising bias means or applying a force urging the cam to rotate about the axis sufficiently to maintain the engagement lobe oriented toward the working surface whenever the clamp is not resting upright on the reference surface so as to ensure engagement of the contact edge with the under-surface of the lifting member whenever the lifting member is being used to elevate the clamp off the reference surface.

38. A clamp as recited in claim 36 further comprising means for releasing engagement of the contact edge with the under-surface of the lifting member whenever the clamp is resting upright on the reference surface.

39. A clamp receiving and gripping a rigid longitudinally extended lifting member having a lifting surface and an opposing under-surface, the clamp comprising:

a socket that longitudinally receives the lifting member, the socket comprising a working surface that contacts at least a portion of the lifting surface whenever the lifting member is being used to elevate the clamp off a reference surface;

a cam mounted to the socket to permit rotation of the cam about an axis that is transverse to the socket and spaced apart from the working surface, the cam being positioned such that, whenever the lifting member is being used to elevate the socket off the reference surface, the lifting member is situated between the cam and the working surface, the cam comprising an engagement lobe defining a contact edge having an outwardly radiating spiraled profile relative to the axis, the engagement lobe extending, whenever the socket is not resting upright on the reference surface, toward the working surface so as to allow a location on the contact edge to engage the under-surface of the lifting member at a contact angle whenever the lifting surface is in contact with the working surface and the lifting member is being used to elevate the socket off the reference surface, the contact angle being substantially constant independently of how the cam is oriented on the axis as the contact edge engages the under-surface of the lifting member, the cam being rotatable about the axis so as to apply a force against the under-surface of the lifting member that presses the lifting surface against the working surface whenever the lifting member has elevated the socket off the reference surface and the socket is being urged to move forwardly on the lifting member but not when the socket is being urged to move rearwardly on the lifting member, the force having a magnitude and being defined by a vector $F_S$ that remains oriented on a line perpendicular to the axis and passing through the location on the contact edge regardless of the magnitude of $F_S$ correspondingly increases whenever the socket is being urged more strongly to move forwardly on the lifting member.

40. A clamp as recited in claim 39 further comprising bias means for applying a force urging the cam to rotate about the axis sufficiently to maintain the engagement lobe oriented toward the working surface whenever the clamp is not resting upright on the reference surface so as to ensure engagement of the contact edge with the under-surface of the lifting member whenever the lifting member is being used to elevate the clamp off the reference surface.

41. A clamp as recited in claim 39 further comprising means for releasing engagement of the contact edge with the under-surface of the lifting member whenever the clamp is resting upright on the reference surface.

42. An implement that is releasably attachable to a rigid, longitudinally extended lifting member, the lifting member having a lifting surface and an opposing under-surface, the implement comprising:

a working surface that contacts the lifting surface for the purpose of elevating the implement off a reference surface using the lifting member; and a cam mounted to the working surface to permit rotation of the cam about an axis that is transverse to, spaced apart from, and fixed relative to the working surface such that, whenever the lifting member is engaged against the working surface for the purpose of elevating the implement, the lifting member is situated between the cam and the working surface, the cam comprising an engagement lobe defining a contact edge having an outwardly radiating spiraled profile relative to the axis, the engagement lobe extending, whenever the implement is not resting upright on the reference surface, toward the working surface so as to allow a location on the contact edge to engage the under-surface of the lifting member whenever the lifting surface is in contact with the working surface and the lifting member is being used to elevate the implement off the reference surface, the cam being rotatable about the axis so as to self-lock against and thus apply a force against the under-surface of the lifting member that presses the lifting surface against the working surface whenever the lifting member has elevated the implement off the reference surface and the implement is being urged to move forwardly on the lifting member but not when the implement is being urged to move rearwardly on the lifting member, the force having a magnitude that correspondingly increases whenever the implement is being urged more strongly to move forwardly on the lifting member.

43. An implement that is releasably attachable to a rigid, longitudinally extended lifting member, the lifting member having a lifting surface and an opposing under-surface, the implement comprising:

a working surface that contacts the lifting surface for the purpose of elevating the implement off a reference surface using the lifting member; and a cam mounted to the working surface to permit rotation of the cam about an axis that is transverse to and spaced apart from the working surface, the cam being positioned such that, whenever the lifting member is being used to elevate the implement off the reference surface, the lifting member is situated between the cam and the working surface, the cam comprising an engagement lobe defining a contact edge having an outwardly radiating spiraled profile relative to the axis, the engagement lobe extending, whenever the implement is not resting upright on the reference surface, toward the working surface so as to allow a location on the contact edge to engage the under-surface of the lifting member and self-lock against said under-surface at a contact angle whenever the lifting surface is in contact with the working surface and the lifting member is being used to elevate the implement off the reference surface, the contact angle being substantially constant independently of how the cam is oriented on the axis as the contact edge engages the under-surface of the lifting member, the cam being rotatable about the axis so as to apply a force against the under-surface of the lifting member that presses the lifting surface against the working surface whenever the lifting member has elevated the implement off the reference surface and the implement is being urged to move forwardly on the lifting member but not when the implement is being urged to move rearwardly on the lifting member, the force having a magnitude that correspondingly increases whenever the implement is being urged more strongly to move forwardly on the lifting member.

44. An implement that is releasably attachable to a rigid, longitudinally extended lifting member, the lifting member having a lifting surface and an opposing under-surface, the implement comprising:

a working surface that contacts the lifting surface for the purpose of elevating the implement off a reference surface using the lifting member; and a cam mounted to the working surface to permit rotation of the cam about an axis that is transverse to and spaced apart from the working surface, the cam being positioned such that, whenever the lifting member is being used to elevate the implement off the reference surface, the lifting member is situated between the cam and the working surface, the cam comprising an engagement lobe defining a contact edge having an outwardly radiating spiraled profile relative to the axis, the engagement lobe extending, whenever the implement is not resting upright on the reference surface, toward the working surface so as to allow a location on the contact edge to engage the under-surface of the lifting member at a contact angle whenever the lifting surface is in contact with the working surface and the lifting member is being used to elevate the implement off the reference surface, the contact angle being substantially constant independently of how the cam is oriented on the axis as the contact edge engages the under-surface of the lifting member, the cam being rotatable about the axis so as to apply a force against the under-surface of the lifting member that presses the lifting surface against the working surface whenever the lifting member has elevated the implement off the reference surface and the implement is being urged to move forwardly on the lifting member but not when the implement is being urged to move rearwardly on the lifting member, the force having a magnitude and being defined by a vector $F_S$ that remains oriented on a line perpendicular to the axis and passing through the location on the contact edge regardless of the magnitude of $F_S$ which correspondingly increases whenever the implement is being urged more strongly to move forwardly on the lifting member.

* * * * *

UNITED STATES PATENT AND TRADEMARK OFFICE

CERTIFICATE OF CORRECTION

PATENT NO. : 5,433,493

DATED : July 18, 1995

INVENTOR(S) : DIX ET AL.

It is certified that error appears in the above-identified patent and that said Letters Patent is hereby corrected as shown below:

Column 1, line 27, after "vehicle" insert a period --.--.

Column 2, lines 33-34, "the cam pivot axis is not fixed" should be underlined.

Column 10, line 29, "O, r, a, a, and $\theta$" should be --O, $r$, $\alpha$, $a$, and $\theta$--.

Column 10, line 35, "$r=a.e^{m.rad\theta}$" should be --$r = a \cdot e^{m \cdot rad\theta}$--.

Column 10, line 36, "$h=a.e^{m.rad\theta}\cos\alpha$" should be --$h = a \cdot e^{m \cdot rad\theta}\cos\alpha$--.

Column 11, line 38, "value of e" should be --value of $\alpha$--.

Column 22, line 36, after "surface" insert --that--.

Column 25, line 41, "thug" should be --thus--.

UNITED STATES PATENT AND TRADEMARK OFFICE

CERTIFICATE OF CORRECTION

PATENT NO. : 5,433,493

DATED : July 18, 1995

INVENTOR(S) : Mark J. Dix, et al.

It is certified that error appears in the above-indentified patent and that said Letters Patent is hereby corrected as shown below:

Column 28, line 12, after "$F_s$" insert --which--.

Signed and Sealed this

Twenty-first Day of May, 1996

Bruce Lehman

*Attest:*

BRUCE LEHMAN

*Attesting Officer*

*Commissioner of Patents and Trademarks*